US009771226B2

(12) United States Patent
Zensai

(10) Patent No.: US 9,771,226 B2
(45) Date of Patent: Sep. 26, 2017

(54) FEEDING DEVICE AND IMAGE FORMING APPARATUS

(71) Applicant: CANON KABUSHIKI KAISHA, Tokyo (JP)

(72) Inventor: Shoichi Zensai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/955,839

(22) Filed: Dec. 1, 2015

(65) Prior Publication Data

US 2016/0159590 A1 Jun. 9, 2016

(30) Foreign Application Priority Data

Dec. 3, 2014 (JP) ..... 2014-245211

(51) Int. Cl.
*B65H 3/06* (2006.01)
*B65H 1/18* (2006.01)
(Continued)

(52) U.S. Cl.
CPC ..... *B65H 3/0684* (2013.01); *B65H 1/14* (2013.01); *B65H 1/18* (2013.01); *B65H 7/04* (2013.01);
(Continued)

(58) Field of Classification Search
CPC ... B65H 1/04; B65H 1/08; B65H 1/14; B65H 3/06; B65H 3/067; B65H 3/0684;
(Continued)

(56) References Cited

U.S. PATENT DOCUMENTS 8,167,300 B1 * 5/2012 Blair ..... B65H 1/14 271/155
2006/0180986 A1 * 8/2006 Hattori ..... B65H 1/14 271/110

(Continued)

FOREIGN PATENT DOCUMENTS

JP 2002-167058 A 6/2002
JP 2011-153014 A 8/2011

(Continued)

*Primary Examiner* — David H Bollinger
(74) *Attorney, Agent, or Firm* — Canon U.S.A., Inc. IP Division

(57) ABSTRACT

A feeding device includes a stacking member, a raising device, a feeding member, an interlocking device including a sheet contact portion, a switching device, a holding member, and a movement device. The feeding member is movable between contact and retracting positions, and rotates in contact with a sheet stacked on the stacking member in a state of being located at the contact position. The sheet contact portion contacts the stacked sheet, and moves by being pressed against the stacked sheet where the raising device raises the stacking member. The switching device switches the raising device between a permitted state and a regulated state. The movement device moves the feeding member to the retracting position above the contact position by moving the holding member. The raising device does not change from the regulated state to the permitted state when the movement device moves the feeding member to the retracting position.

17 Claims, 21 Drawing Sheets

(51) Int. Cl.
*B65H 1/14* (2006.01)
*B65H 7/04* (2006.01)

(52) U.S. Cl.
CPC .. *B65H 2403/421* (2013.01); *B65H 2403/481* (2013.01); *B65H 2403/53* (2013.01); *B65H 2403/72* (2013.01); *B65H 2403/724* (2013.01); *B65H 2403/942* (2013.01); *B65H 2511/414* (2013.01); *B65H 2511/515* (2013.01); *B65H 2513/40* (2013.01)

(58) Field of Classification Search
CPC .. B65H 2405/31; B65H 2405/32; B65H 1/18; B65H 7/04; B65H 2403/421; B65H 2403/481; B65H 2403/53; B65H 2403/72; B65H 2403/724; B65H 2403/942; B65H 2511/414; B65H 2511/515; B65H 2513/40
USPC ..... 271/117, 118, 126, 127, 152, 153, 154, 271/155
See application file for complete search history.

(56) References Cited

U.S. PATENT DOCUMENTS

| | | | | |
|---|---|---|---|---|
| 2008/0001342 | A1* | 1/2008 | Matsushima | B65H 1/14 271/3.14 |
| 2008/0128973 | A1* | 6/2008 | Hirose | B65H 3/0684 271/117 |
| 2009/0008868 | A1* | 1/2009 | Kuroda | B65H 3/0607 271/162 |
| 2011/0156342 | A1* | 6/2011 | Iino | B65H 3/0684 271/10.11 |
| 2013/0223906 | A1* | 8/2013 | Tomatsu | G03G 15/757 399/361 |
| 2013/0292896 | A1* | 11/2013 | Yoshii | B65H 1/14 271/97 |

FOREIGN PATENT DOCUMENTS

| | | |
|---|---|---|
| JP | 2012-030956 A | 2/2012 |
| JP | 2013-173601 A | 9/2013 |
| JP | 2013-180842 A | 9/2013 |

* cited by examiner 13
16
9
29
8
65a
S
21
X

FIG.16

| | $X < h2$ | $h2 \leq X \leq h1$ | $h1 < X$ |
|---|---|---|---|
| FIRST LATCHING MEMBER 74 | UNLATCH CONTROL GEAR 76 | UNLATCH ⇔ LATCH | LATCH CONTROL GEAR 76 |
| SECOND LATCHING MEMBER 75 | LATCH CONTROL GEAR 76 | LATCH ⇔ UNLATCH | UNLATCH CONTROL GEAR 76 |
| THIRD LATCHING MEMBER 73 | LATCH GEAR TO BE ENGAGED 72 | LATCH ⇔ UNLATCH | UNLATCH GEAR TO BE ENGAGED 72 |
| PLANETARY GEAR MECHANISM 67 | TRANSMITTED STATE | TRANSMIT ⇔ BLOCK | BLOCKED STATE |

FEEDING DEVICE AND IMAGE FORMING APPARATUS

BACKGROUND OF THE INVENTION

Field of the Invention

The present invention relates to a feeding device and an image forming apparatus.

Description of the Related Art

Conventionally, an image forming apparatus such as a copying machine, a printer, and a facsimile machine includes a feeding device for feeding sheets to an image forming unit. The feeding device is provided with a sheet storage device that stores sheets to be fed. An example of the sheet storage device is a feeding cassette detachably attached to the image formation apparatus.

A feeding cassette discussed in Japanese Patent Application Laid-Open No. 2013-180842 is illustrated in FIG. 19. An intermediate plate (stacking member) 901 in a feeding cassette 900 is provided in a casing 903 to be rotatable in a vertical direction around a rotating shaft 903*a*. A lifting plate 902 pushes up the downstream side of the intermediate plate 901 in a feeding direction of the sheets S. Thus, the sheet S stacked on the intermediate plate 901 contact a pickup roller (feeding member) 904 with a predetermined pressing force. The sheet S, which has been pushed up by the intermediate plate 901, is fed by the pickup roller 904, and is sent out in a stable state by a conveyance roller 905 on the downstream side thereof. Japanese Patent Application Laid-Open No. 2013-180842 discusses lifting up the intermediate plate 901 when a sheet surface detection member contacting upper surface of the sheets S detects that the height of the uppermost surface of the sheets S has been lowered. In this way, the height of the uppermost surface of the sheets S can be kept within a predetermined range, and a feeding condition can be stabilized.

Japanese Patent Application Laid-Open No. 2012-030956 discusses raising and lowering a pickup roller relative to stacked sheets using a driving force of a driving source.

SUMMARY OF THE INVENTION

The present invention is directed to developing techniques discussed in Japanese Patent Application Laid-Open Nos. 2013-180842 and 2012-030956. More specifically, the present invention is directed to keeping a position of an uppermost sheet stacked on a stacking member appropriately in an apparatus having a configuration in which the stacking member is raised and a configuration in which a feeding member is moved upward. To keep a position of an uppermost sheet stacked on a stacking member proper in an apparatus having a configuration in which the stacking member is raised and a configuration in which a feeding member is moved upward, a rotation stop portion (contact portion) of a sheet surface control member contacts a rib (contacting portion) of a roller holder in a case where a movement device moves the roller holder upward to separate a pickup roller. With this operation, upward movement of the sheet surface control member is regulated, so that a position of the sheet surface control member corresponding to the roller holder is determined.

The present invention is directed to a feeding device and an image forming apparatus capable of maintaining a position of an uppermost sheet stacked on a stacking member within a proper range and obtaining a stable feeding performance.

According to an aspect of the present invention, a feeding device includes a stacking member configured to stack a sheet thereon, a raising device configured to raise the stacking member, a feeding member configured to be movable between a contact position and a retracting position, and rotate in contact with the sheet stacked on the stacking member in a state of being located at the contact position to feed the sheet, an interlocking device including a sheet contact portion configured to contact the sheet stacked on the stacking member, and configured to move by being pressed against the sheet stacked on the stacking member in a case where the raising device raises the stacking member, a switching device configured to mechanically switch the raising device between a permitted state where the stacking member is permitted to rise and a regulated state where the rise of the stacking member is regulated according to a position of the interlocking device, a holding member configured to hold the feeding member and the interlocking device, and a movement device configured to move the feeding member to the retracting position above the contact position by moving the holding member, wherein the raising device does not change from the regulated state to the permitted state when the movement device moves the feeding member to the retracting position by moving the holding member.

Further features of the present invention will become apparent from the following description of exemplary embodiments with reference to the attached drawings.

BRIEF DESCRIPTION OF THE DRAWINGS

FIG. 16 is a table illustrating a position of an uppermost sheet stacked on a stacking plate and a state of each member in a switching device according to the first exemplary embodiment.

DESCRIPTION OF THE EMBODIMENTS

Figure 1:
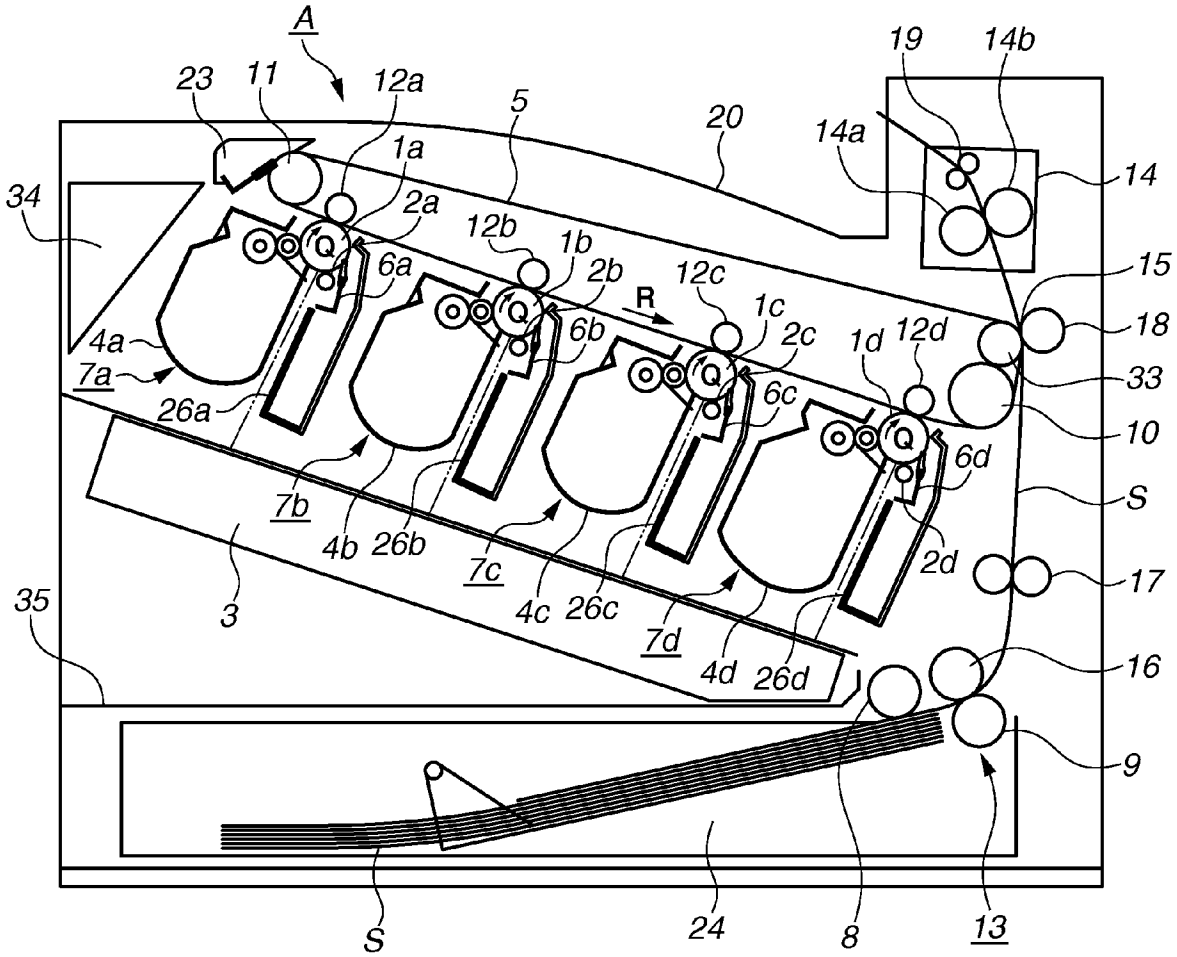
FIG. 1 is a schematic sectional view illustrating an image forming apparatus according to a first exemplary embodiment.

Exemplary embodiments of the present invention will be specifically described below with reference to the drawings. However, sizes, materials, and shapes of components described therein and their relative arrangement can be changed, as needed, depending on a configuration of an apparatus to which the present invention is applied and various conditions. Therefore, the present invention is not to be limited to the exemplary embodiments described below unless otherwise specifically described.

An image forming apparatus according to a first exemplary embodiment will be described with reference to FIGS. 1 to 17B. An entire configuration of the image forming apparatus will be first described below with reference to FIG. 1. Next, a configuration of a feeding device will be described with reference to FIGS. 2A to 13E.

The entire configuration of the image forming apparatus will be described below with reference to FIG. 1. An image forming unit A includes four process cartridges 7 (i.e., process cartridges 7*a* to 7*d*) provided side by side while being inclined in a horizontal direction. The process cartridges 7 respectively include electrophotographic photosensitive drums 1 (i.e., photosensitive drums 1*a* to 1*d*) each serving as one image bearing member.

The electrophotographic photosensitive drums (hereinafter referred to as "photosensitive drums") 1 are driven to rotate in a clockwise direction (a direction indicated by an arrow Q) in FIG. 1 by a driving member (not illustrated). Process units 2, 3, 4, 5, and 6, which act on the photosensitive drums 1 are arranged in this order in a direction of the rotation around the photosensitive drums 1. The charging rollers 2 (i.e., charging rollers 2*a* to 2*d*) respectively uniformly charge surfaces of the photosensitive drum 1. The development units 4 (i.e., development units 4*a* to 4*d*) respectively develop electrostatic latent images using toners serving as developers. The cleaning members 6 (i.e., cleaning members 6*a* to 6*d*) respectively remove the toners that remain on the surfaces of the photosensitive drums 1 after being transferred thereonto. The scanner unit 3 emits laser beams based on image information, to respectively form the electrostatic latent images on the photosensitive drums 1. Respective developer (hereinafter referred to as "toner") images in four colors on the photosensitive drums 1 are transferred onto the intermediate transfer belt 5. The photosensitive drum 1, the charging roller 2, the development unit 4, and the cleaning member 6 are integrally formed into a cartridge, to constitute the process cartridge 7 detachably attached to a mounting portion of the image forming unit A.

The intermediate transfer belt 5 is stretched around a drive roller 10, a tension roller 11, and a secondary transfer counter roller 33. Primary transfer rollers 12 (i.e., primary transfer rollers 12*a* to 12*d*) respectively opposing the photosensitive drums 1 (photosensitive drums 1*a* to 1*d*) are provided inside the intermediate transfer belt 5. A bias application unit (not illustrated) applies a transfer bias to each of the primary transfer rollers 12.

The toner images respectively formed on the photosensitive drums 1 are sequentially primarily transferred onto the intermediate transfer belt 5 when the photosensitive drums 1 rotate in the direction indicated by the arrow Q, the intermediate transfer belt 5 rotates in a direction indicated by an arrow R, and positive-polarity biases are further applied to the primary transfer rollers 12. The toner images primarily transferred onto the intermediate transfer belt 5 are conveyed to a secondary transfer portion 15 with the toner images in four colors being overlapped on the intermediate transfer belt 5.

On the other hand, the cleaning members 6 respectively remove the toners that remain on the surfaces of the photosensitive drums 1. The removed toners are respectively recovered in removed toner chambers in the photosensitive units 26 (26*a* to 26*d*).

A feeding device 13 and a registration roller pair 17 convey a sheet S serving as recording media in synchronization with the above described image forming operation.

A cassette upper stay 35, which is a part of a structure and separates a feeding cassette 24 and the image forming unit A, is provided on the feeding cassette 24. The feeding cassette 24 can be pulled out in a front side direction of the image forming apparatus illustrated in FIG. 1. A user pulls out the feeding cassette 24 from an apparatus body, sets the sheets S, and inserts the feeding cassette 24 into the apparatus body, to complete resupply of the sheets S. A pickup roller 8 picks up the sheets S stored in the feeding cassette 24. The sheets S are separated one by one by a nip between a feed roller 16 and a separation roller 9, and the separated sheet is conveyed.

Then, the sheet S, which has been conveyed from the feeding device 13, is then conveyed to the secondary transfer portion 15 by the registration roller pair 17. At the secondary transfer portion 15, the toner images in four colors on the intermediate transfer belt 5 are secondarily transferred onto the conveyed sheet S by applying the positive-polarity bias to a secondary transfer roller 18.

A transfer belt cleaning device 23 removes the toner remaining on the intermediate transfer belt 5 after being secondarily transferred onto the sheet S. The removed toner is collected in a waste toner collecting container 34 arranged on the left side of the image forming apparatus after passing through a waste toner conveyance path (not illustrated).

On the other hand, a fixing device 14 serving as a fixing unit applies heat and pressure to the toner image, which has been transferred onto the sheet S, to fix the toner image onto the sheet S. A fixing belt 14*a* is in a cylindrical shape, and is guided by a belt guiding member (not illustrated) to which a heating unit such as a heater has adhered. The fixing belt 14*a* and a pressure roller 14*b* form a fixing nip with a predetermined pressing force.

The sheet S on which an unfixed toner image, which has been conveyed from the secondary transfer portion 15, is formed is heated and pressurized at the fixing nip between the fixing belt 14*a* and the pressure roller 14*b* so that the unfixed toner image on the sheet S is fixed thereto. Then, a discharge roller pair 19 discharges the sheet S, to which the toner image has been fixed, onto a discharge tray 20.

<Outline of Feeding Device>

The feeding device 13 according to the first exemplary embodiment is arranged in a lower part of the image forming unit A, as illustrated in FIG. 1. The feeding cassette 24 is attachable to and detachable from the image forming unit A. The fixing device 13 feeds the sheets S stacked on a stacking plate (stacking member) 21 one by one toward an image forming portion (the secondary transfer portion 15 and the fixing device 14) arranged in an upper part of the image forming unit A.

Figures 2A, 2B, 2C:
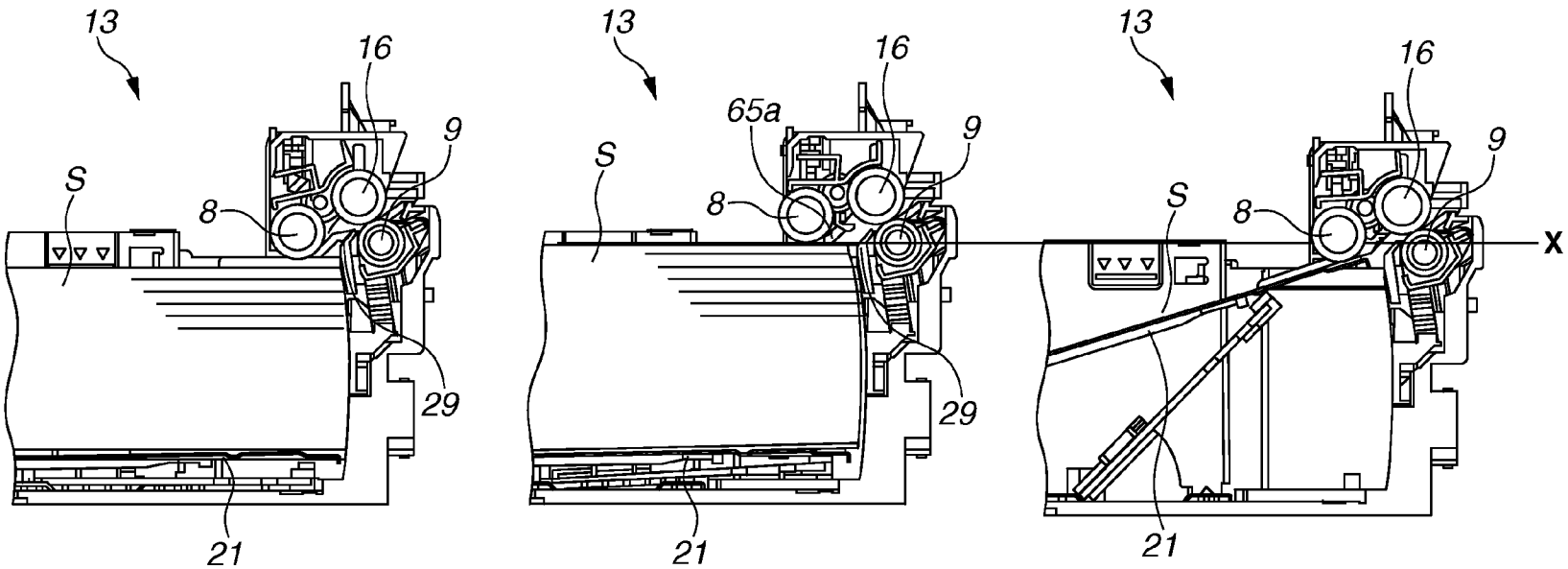
FIGS. 2A, 2B, and 2C are cross-sectional views illustrating a feeding device according to the first exemplary embodiment.

FIGS. 2A, 2B, and 2C are cross-sectional views illustrating a configuration of the feeding device 13. A detailed configuration of the feeding device 13 will be described with reference to FIGS. 2A, 2B, and 2C. FIG. 2A illustrates a state where a large number of sheets S are stacked on the stacking plate 21 in the feeding device 13. FIG. 2B illustrates a state where the sheets S stacked on the stacking plate 21 are in a feedable state by lifting the stacking plate 21 upward from the state illustrated in FIG. 2A. FIG. 2C illustrates a state where the one sheet S is stacked on the stacking plate 21 in the feeding device 13 and is in a feedable state. As illustrated in FIGS. 2B and 2C, the stacking plate 21 is lifted up until a position of the uppermost sheet S reaches a position X.

The feeding device 13 includes the pickup roller (feeding member) 8 for sending out the sheets S stacked on the stacking plate 21 from the top. The pickup roller 8 rotates while contacting the sheet S stacked on the stacking plate 21, to feed the sheet S. The feeding device 13 includes the feed roller 16 for conveying the sheet S fed by the pickup roller 8 and the separation roller 9 pressure-contacting the feed roller 16. At a separation nip portion formed between the feed roller 16 and the separation roller 9, the sheets S are separated one by one along a nip guide member 29 provided just ahead of the separation nip portion, and the separated sheet is conveyed one by one. A torque limiter (not illustrated) is provided between the separation roller 9 and an axis of the separation roller 9. The torque of the torque limiter is set so that, when the number of sheets fed by the pickup roller 8 is one, the separation roller 9 rotates while being driven by the sheet S conveyed by the feed roller 16. The torque of the torque limiter is set so as to prevent, when the number of sheets fed by the feeding roller 8 is two, the sheet S (the second sheet S) under the sheet S (the first sheet S) contacting the pickup roller 8 from being fed without the separation roller 9 rotating.

Figure 3B:
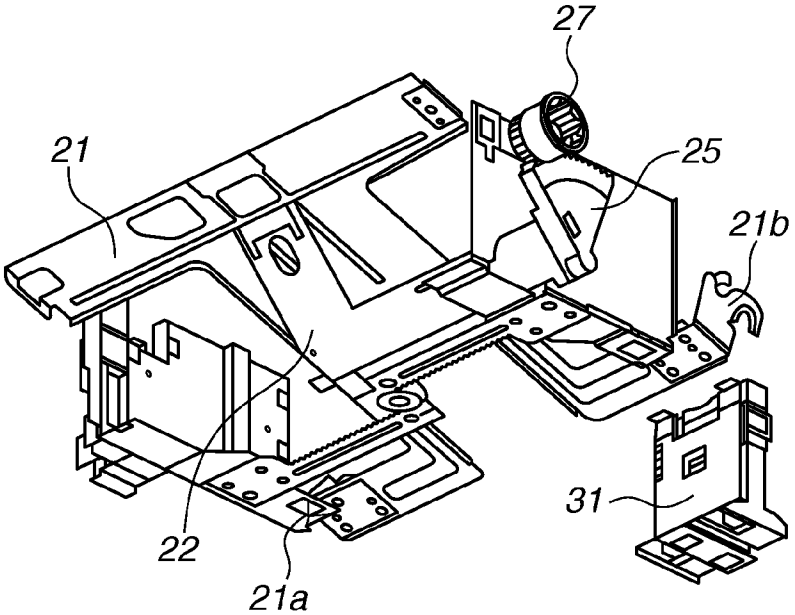
FIGS. 3A and 3B are perspective views illustrating a feeding cassette according to the first exemplary embodiment.
Figure 3A:
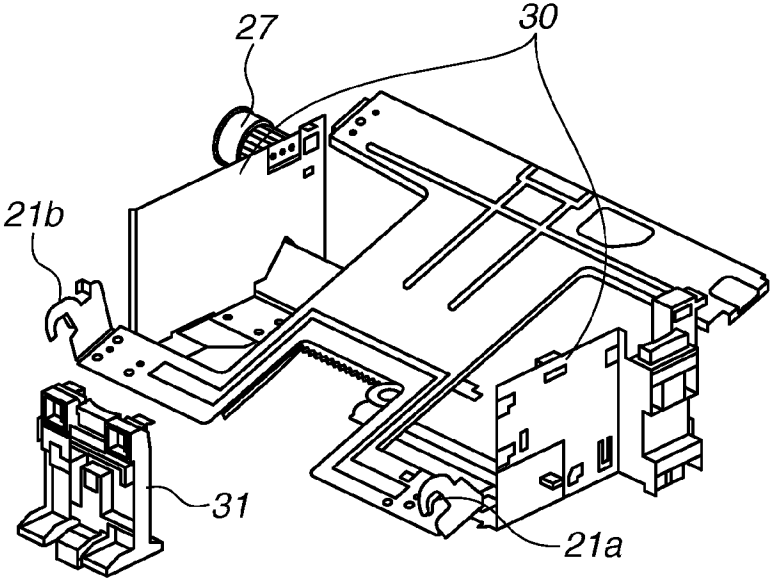

A lifting operation of the stacking plate 21 to raise the sheets S to a position where the sheets S is feedable, will be described below. FIGS. 3A and 3B are perspective views in which a portion, corresponding to a container for the sheets S, of the feeding cassette 24, is removed for illustration. FIG. 3A is a perspective view viewed from the upstream side in a sheet conveyance direction. FIG. 3B is a perspective view illustrating the back side of the stacking plate 21 viewed from the downstream side in the sheet conveyance direction, illustrating a relationship between the stacking plate 21 and a lifting plate 22. As illustrated in FIGS. 3A and 3B, the stacking plate 21 is provided in the feeding cassette 24, and is rotatable (elevatable) in a vertical direction with latching portions 21*a* and 21*b* respectively used as fulcrums.

The lifting plate (raising member) 22 is provided below the stacking plate 21, to push the stacking plate 21 upward. A fan-shaped gear 25 is provided at one end of the lifting plate 22. A pinion 27, which is provided on the feeding cassette 24 side and rotates with a driving force generated by a feeding motor M (driving unit) illustrated in FIG. 6, described below, meshes with the fan-shaped gear 25. When the pinion 27 rotates, the fan-shaped gear 25 rotates, and the lifting plate 22 turns upward. With this operation, the stacking plate 21 turns upward, to raise the sheets S on the stacking plate 21 to a position where sheets S can be fed (a feedable position) by the pickup roller 8. The pinion 27, the fan-shaped gear 25, and the lifting plate 22 constitute a raising unit that performs a raising operation for raising the stacking plate 21.

Figure 10:
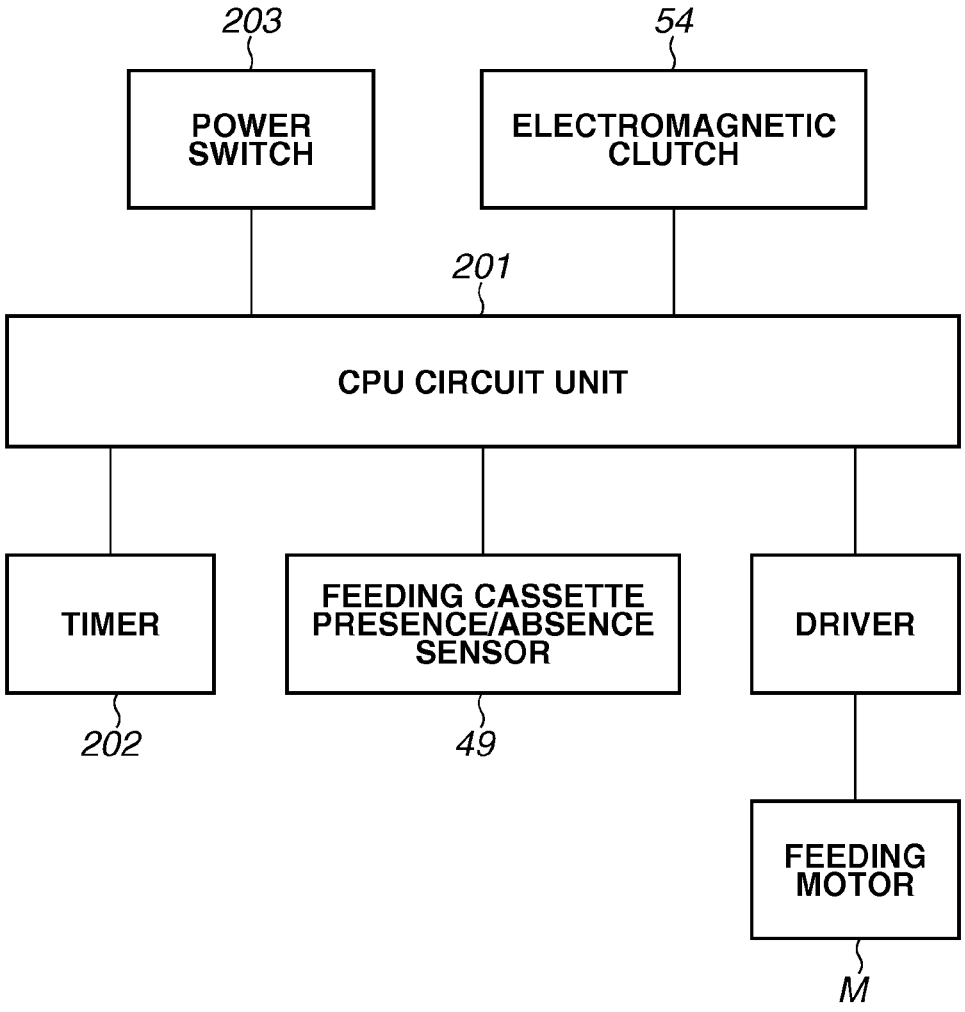
FIG. 10 is a block diagram illustrating a configuration of a controller that controls the feeding device according to the first exemplary embodiment.

The feeding motor M can generate a driving force for performing forward rotation and a driving force for backward rotation, and is controlled to be driven by a central processing unit (CPU) circuit unit 201 (control unit), as illustrated in FIG. 10. The CPU circuit unit 201 drives the feeding motor M based on a detection signal and a print job signal from a feeding cassette presence/absence sensor 49, described below, to rotate the pinion 27. Therefore, the stacking plate 21 is raised until the position of the uppermost sheet S stacked on the stacking plate 21 reaches a predetermined position (i.e., feedable position).

As illustrated in FIGS. 3A and 3B, side regulation members 30 regulate a position of the sheets S stacked on the stacking plate 21 in a direction perpendicular to a feeding direction (a width direction) thereof. The side regulation members 30 are provided in the feeding cassette 24, and are movable in the width direction. The side regulation members 30 are movable independently of the stacking plate 21, and can regulate the width direction of the sheets S by maintaining a fixed state even while the stacking plate 21 is moving (rising). A trailing edge regulation member 31 regulates a position of the sheets S stacked on the stacking plate 21 at an upstream edge (trailing edge) in the feeding direction thereof. The trailing edge regulation member 31 is provided in the feeding cassette 24, and is movable in the feeding direction.

Figure 4B:
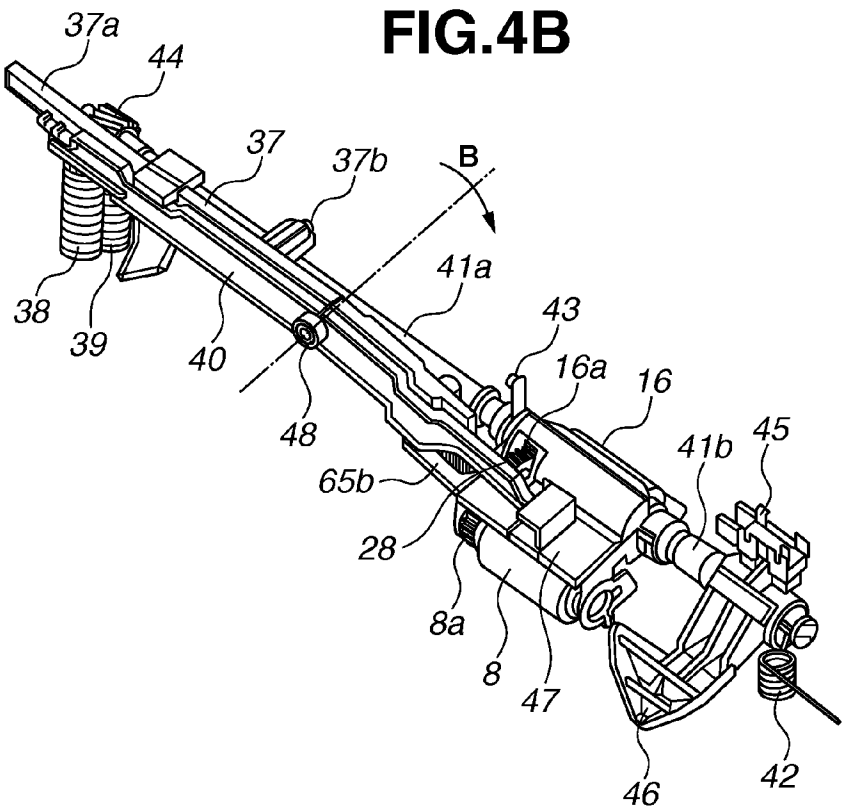
FIGS. 4A, 4B, and 4C are perspective views illustrating a configuration of a feeding frame unit and a pickup roller according to the first exemplary embodiment.
Figure 4A:
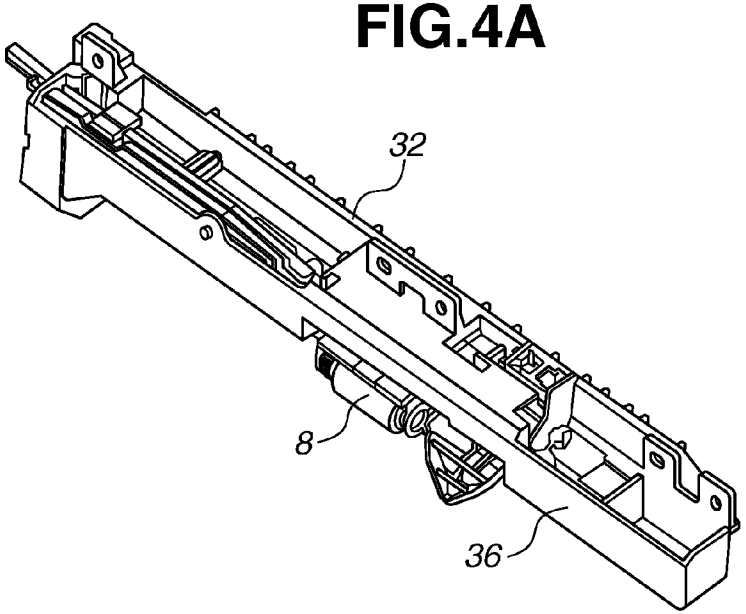
Figure 4C:
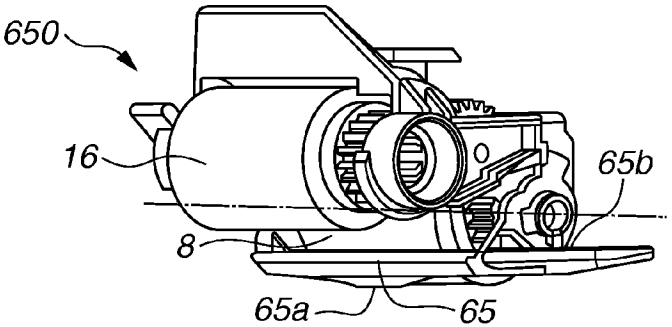

The feeding frame unit 32 will be described with reference to FIGS. 4A, 4B, and 4C. FIG. 4B is a diagram obtained by removing a feeding frame 36 from FIG. 4A for illustration. FIG. 4C illustrates a roller unit 650. The feeding frame unit 32 includes a sheet surface control lever 37, compression springs 38 and 39, a pressing lever 40, and a pickup roller 8. The feeding frame unit 32 includes a feed roller 16, feed roller shafts 41*a* and 41*b*, a torsion coil spring 42, a bearing 43, a gear 44, a sheet presence/absence sensor 45, a sheet presence/absence flag 46, and a sheet surface control member 65, which are retained in the feeding frame 36.

For the roller unit 650, the retention of the pickup roller 8, the feed roller 16, and the sheet surface control member 65 will be described. The pickup roller 8 is retained with a roller holder (retention member) 47. The roller holder 47 is provided to be rotatable around the feed roller shafts 41*a* and 41*b*. The sheet surface control member 65 is rotatably attached to the roller holder 47 on the same axis of the pickup roller 8. The sheet surface control member 65 includes a sheet contact portion 65*a* contacting the uppermost sheet S stacked on the stacking plate 21 and a lever contact portion 65*b* contacting the sheet surface control lever 37, described below.

The feed roller 16 is attached to the feed roller shafts 41*a* and 41*b*. The feed roller shaft 41*a* is rotatably retained with the feeding frame 36 by the bearing 43. The feed roller shaft 41*b* pivots the other side of the feed roller 16. The feed roller shaft 41*b* is retained to be axially slidable with respect to the feeding frame 36. The torsion coil spring 42 is provided between the feed roller shaft 41*b* and the feeding frame 36. The user can replace the roller unit 650, which retains the feed roller 16, the pickup roller 8, and the sheet surface control member 65, as a consumable by sliding the feed roller shaft 41*b*, as needed. A positional relationship between the sheet surface control member 65 and the pickup roller 8 can be kept good by configuring not only the pickup roller 8 but also the sheet surface control member 65, which becomes worn due to sliding relative to the sheets S, to be exchangeable.

A configuration and an operation for pressing the pickup roller 8 against the sheets S will be described. The pressing lever 40 attached to the feeding frame 36 is rotatably retained in the feeding frame 36 around a shaft in its substantially central part. The compression spring 38 is acting on one end of the pressing lever 40 so that the other end of the pressing lever 40 contacts the roller holder 47. In this way, desired feeding pressure of the pickup roller 8 on the sheets S is ensured. More specifically, the compression spring 38 functions as an elastic member that generates an elastic force for the pickup roller 8 to contact the sheets S. Further, the pressing lever 40 functions as a connection member that connects the compression spring 38 and the roller holder 47.

The sheet presence/absence flag 46 and the sheet presence/absence sensor 45 constitute a sheet presence/absence detection unit that detects the presence or absence of the sheets S on the stacking plate 21. If the sheets S are stacked on the stacking plate 21, the sheet presence/absence flag 46 blocks sensor light from the sheet presence/absence sensor 45 in a rising process of the stacking plate 21. On the other hand, if the sheets S are not stacked on the stacking plate 21, the sheet presence/absence flag 46 falls into a hole of the stacking plate 21. Therefore, the sheet presence/absence flag 46 does not block (transmit) the sensor light from the sheet presence/absence sensor 45.

Figure 5B:
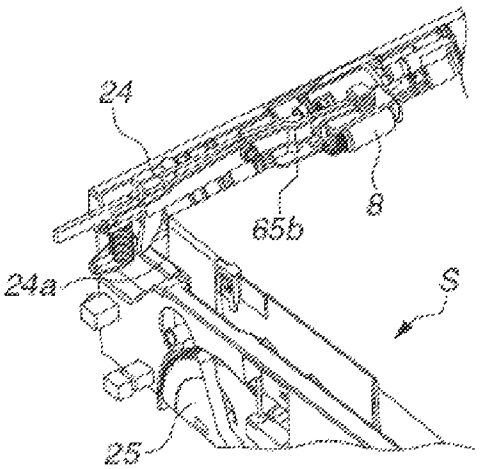
FIGS. 5A, 5B, and 5C are perspective views illustrating a feeding frame unit and a feeding cassette according to the first exemplary embodiment.
Figure 5C:
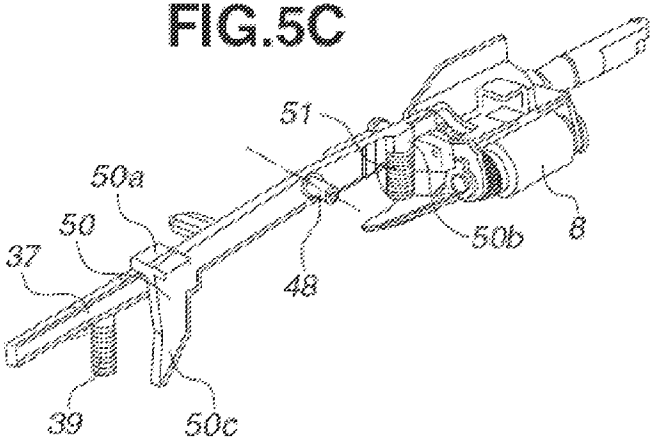
Figure 5A:
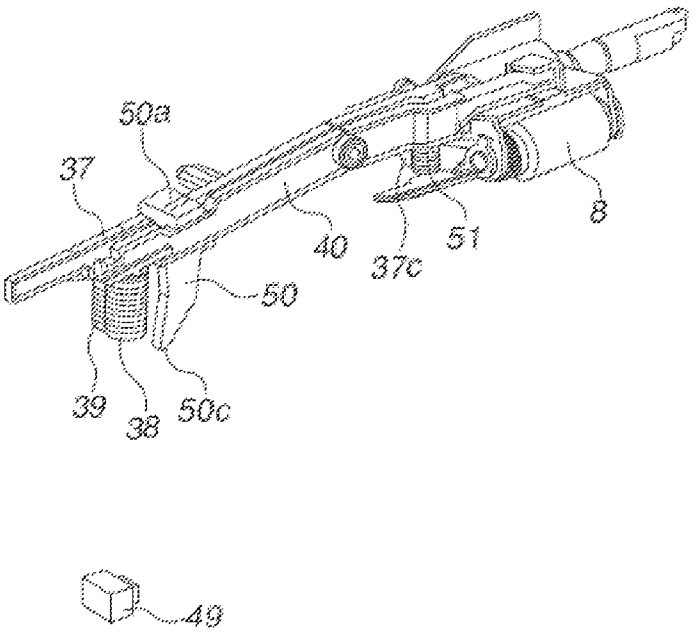

FIGS. 5A, 5B, and 5C illustrate a relationship between the feeding frame unit 32 and the feeding cassette 24. FIG. 5A illustrates a state where the feeding cassette is not mounted on the image forming unit A, FIG. 5B illustrates a state where the feeding cassette 24 is mounted on the image forming unit A, and FIG. 5C is a diagram obtained by removing the pressing lever 40 from FIGS. 5A, 5B, and 5C for illustration. The image forming unit A is provided with the feeding cassette presence/absence sensor 49 for detecting that the feeding cassette 24 is mounted thereon. The feeding frame unit 32 is provided with a release lever 50 to prevent the pickup roller 8 and the sheets S from being rubbed by each other as much as possible when the feeding cassette 24 is mounted and pulled out. The release lever 50 is provided to be swingable around the shaft 48 serving as a rotation center, and receives a force to rotate in a counterclockwise direction in FIG. 5C by an action of the compression spring 51 on the pickup roller 8 side.

When the feeding cassette 24 is pulled out of the feeding device 13, the release lever 50 receives a force in a downward direction in FIGS. 5A, 5B, and 5C by the compression spring 51 provided between the feeding frame 36 and an end 50*b* of the release lever 50. The sheet surface control lever 37 and the pressing lever 40 are pushed downward in FIGS. 5A, 5B, and 5C (rotate in a counterclockwise direction) by a release portion 50*a* in the release lever 50. When the pressing lever 40 rotates in the counterclockwise direction, the pickup roller 8 retracts upward. The release lever 50 is stopped at a position where it contacts a contact portion (not illustrated) of the feeding frame 36. A moment generated by the compression spring 51 is set to exceed the moments generated by the compression springs 38 and 39.

An end 50*c* of the release lever 50 runs over a sidewall 24*a* of the feeding cassette 24 in an inserting process of the feeding cassette 24 into the feeding device 13. Thus, the sheet surface control lever 37 and the pressing lever 40 rotate in the clockwise direction so that the retracting of the pickup roller 8 is released. The sheet surface control lever 37 and the pressing lever 40 can operate in a range required for a feeding operation with the feeding cassette 24 mounted on the feeding device 13.

Figure 6A:
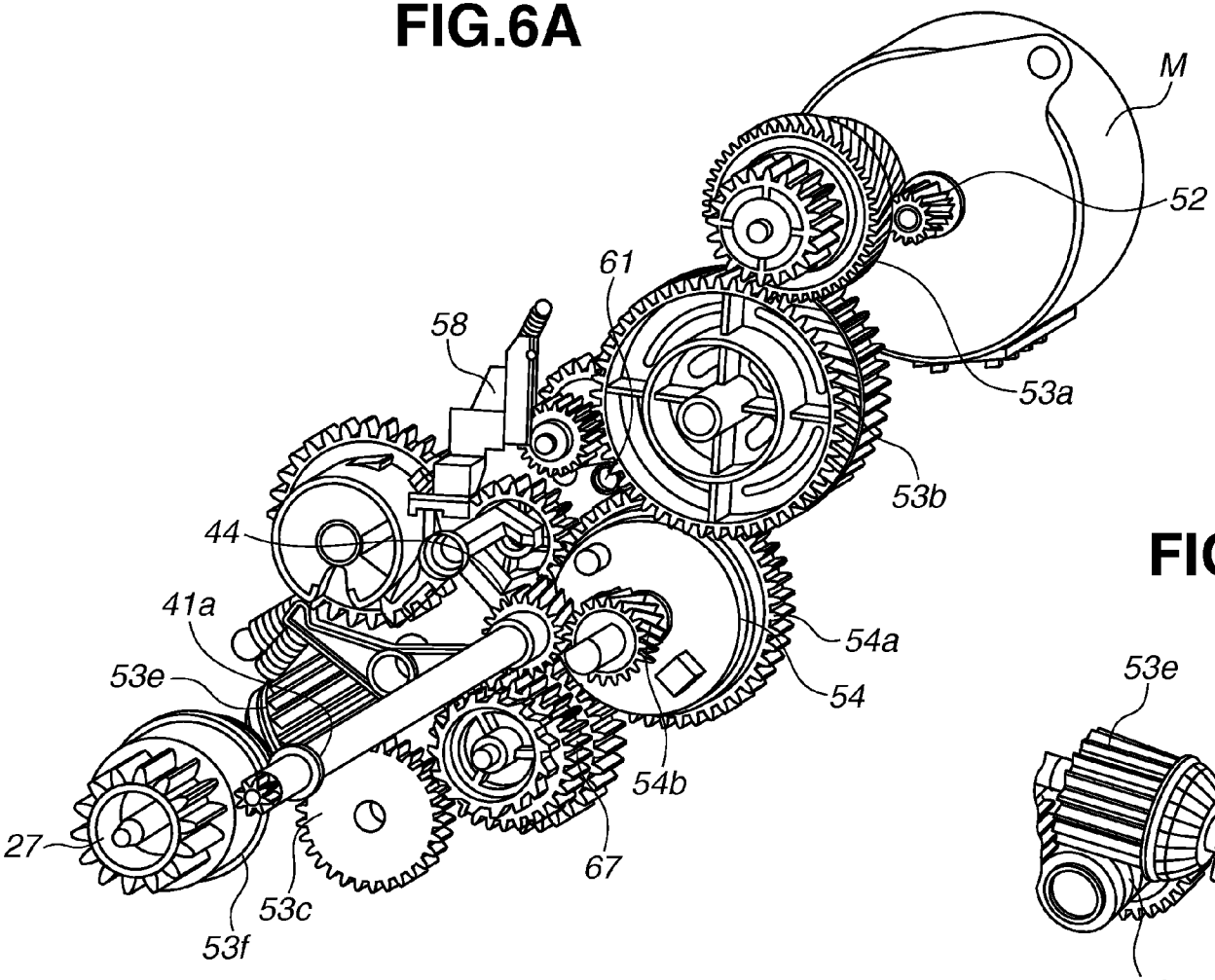
FIGS. 6A and 6B are perspective views illustrating a transmission path of a driving force from a feeding motor according to the first exemplary embodiment.
Figure 6B:
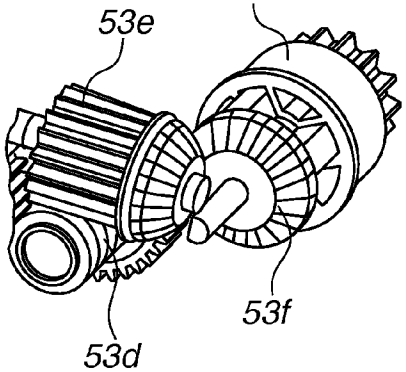

FIGS. 6A and 6B illustrate a transmission path of driving from the feeding motor M. FIG. 6B illustrates a configuration of the pinion 27 on the back side of a sheet surface illustrated in FIG. 6A. The feeding motor M drives the pickup roller 8, the feed roller 16, and the pinion 27. The feeding motor M is connected to an electromagnetic clutch 54 via a pinion 52 and a reduction gear 53*a*. The electromagnetic clutch 54 connects and disconnects the driving force from the feeding motor M. The driving force from the feeding motor M is transmitted to a gear 54*b* illustrated in FIG. 6 via a drive-side gear 54*a* only when the electromagnetic clutch 54 is energized. By transmitting the driving force from the feeding motor M via the electromagnetic clutch 54, a variation in the transmission of the driving can be reduced.

The gear 54*b* is connected to the feed roller shaft 41*a* (FIG. 4B). Element 28 in FIG. 4B is a gear 28. When the feeding motor M rotates and the gear 54*b* rotates, the driving force is transmitted to the gear 44. Thus, the feed roller 16 (the feed roller shaft 41*a*) rotates. A gear 16*a* (FIG. 4B) is attached to an axis of the feed roller 16 via a one-way clutch (not illustrated). The gear 16*a* transmits the driving force to the gear 8*a* (FIG. 4B) provided in an axis of rotation of the pickup roller 8. A one-way clutch is also contained in the axis of the pickup roller 8. This configuration enables a back tension on the registration roller pair 17 to be kept low when a rotation speed of the pickup roller 8 satisfies a relationship of the registration roller pair 17>the feed roller 16>the pickup roller 8. This configuration enables a state where the pickup roller 8 and the sheets S contact each other to be also maintained even in a time period from when the pickup roller 8 feeds the sheet S until it feeds the succeeding sheet S. Therefore, according to this configuration, a feeding interval (an interval between the sheet S and the succeeding sheet S) can be reduced, and a period of time elapsed from the time when an instruction to start a feeding operation is issued until the sheet S is actually fed can be shortened. As a result, a First Print Output Time (FPOT) can also be shortened.

Figure 8:
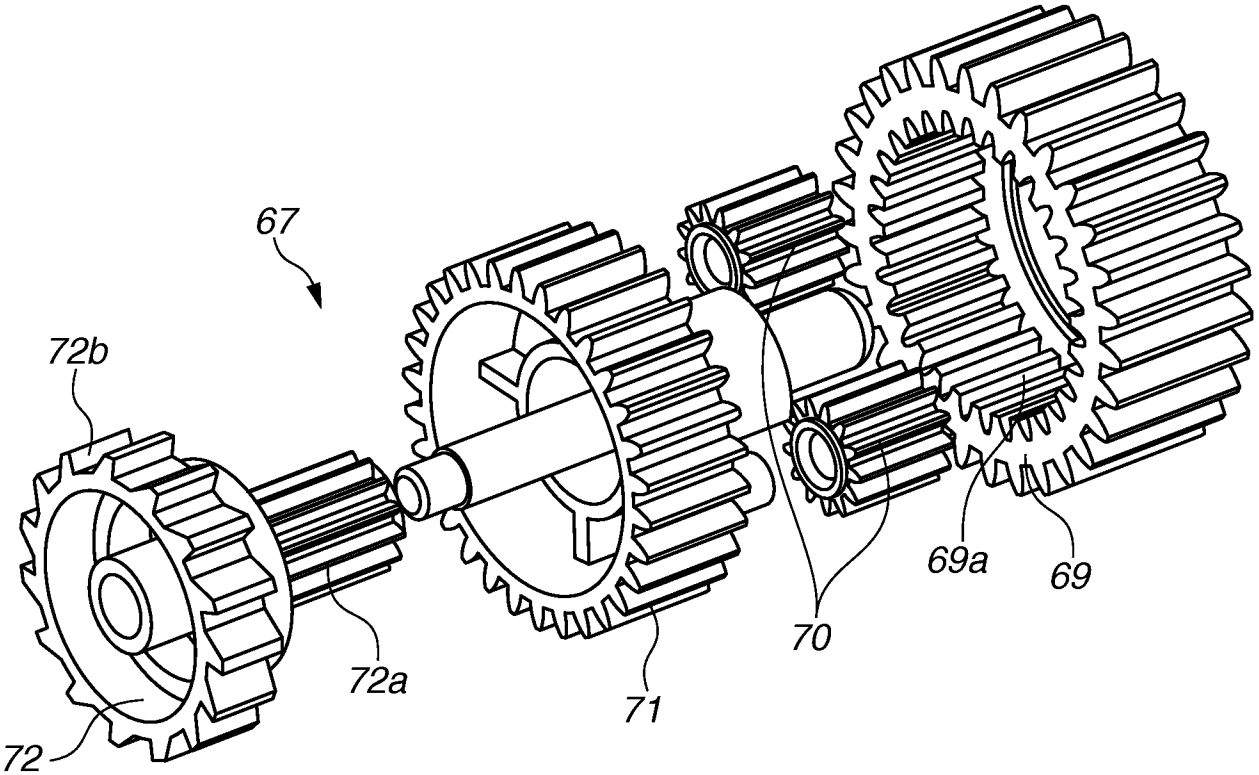
FIG. 8 is an exploded perspective view illustrating a planetary gear mechanism according to the first exemplary embodiment.

In the first exemplary embodiment, a planetary gear mechanism 67 is provided in a part of a driving transmission unit that transmits a driving force of the feeding motor M to the lifting plate 22. The planetary gear mechanism 67 transmits rotation of the drive-side gear 54*a*, which rotates with the driving force of the feeding motor M, to the gear 53*c*. FIG. 8 is an exploded perspective view of the planetary gear mechanism 67. As illustrated in FIG. 8, the planetary gear mechanism 67 includes an input gear 69 having an internal gear 69*a*, a planetary carrier 71 that retains a planetary gear (pinion) 70 that meshes with the internal gear 69*a*, and an engaged gear (i.e., gear to be engaged) 72. The engaged gear 72 includes a sun gear 72*a* that meshes with the planetary gear 70 and an engaged tooth portion (i.e., tooth portion to be engaged) 72*b*. In the planetary gear mechanism 67 in the first exemplary embodiment, the rotation of the drive-side gear 54*a* (FIG. 6A) is transmitted to external teeth of the input gear 69, and the planetary carrier 71 serving as an output gear transmits the driving force of the feeding motor M to the drive gear 53*c* (FIGS. 6A and 6B). As illustrated in FIGS. 6A and 6B, element 53*f* is a gear 53*f* and a worm gear 53*d* and a worm wheel 53*e* are provided in a drive train between the gear 53*c* and the pinion 27. Therefore, even while driving force from the planetary gear mechanism 67 is not input, the gears do not rotate backward due to the weight of the sheets S, and the stacking plate 21 does not fall. The planetary gear mechanism 67 selectively transmits the rotation driving force input to the input gear 69 from the drive-side gear 54*a* to the fan-shaped gear 25 (FIGS. 3A and 3B) via a gear train following the drive gear 53*c*.

Next, a switching device 68, which mechanically switches the planetary gear mechanism 67 between a transmitted state where the driving force is transmitted and a blocked state where the driving force is blocked will be described with reference to FIGS. 7A, 7B, 7C, 7D, and 7E. The switching device 68 does not regulate the rotation of the engaged gear 72 to bring the planetary gear mechanism 67 into the blocked state (a state where the rising of the stacking plate 21 is regulated), and regulates the rotation of the engaged gear 72 to bring the planetary gear mechanism 67 into the transmitted state (a state where the stacking plate 21 can be raised). FIGS. 7A to 7E are side views illustrating an outline of the configuration and the operation of the switching device 68 according to the first exemplary embodiment.

Figure 7A:
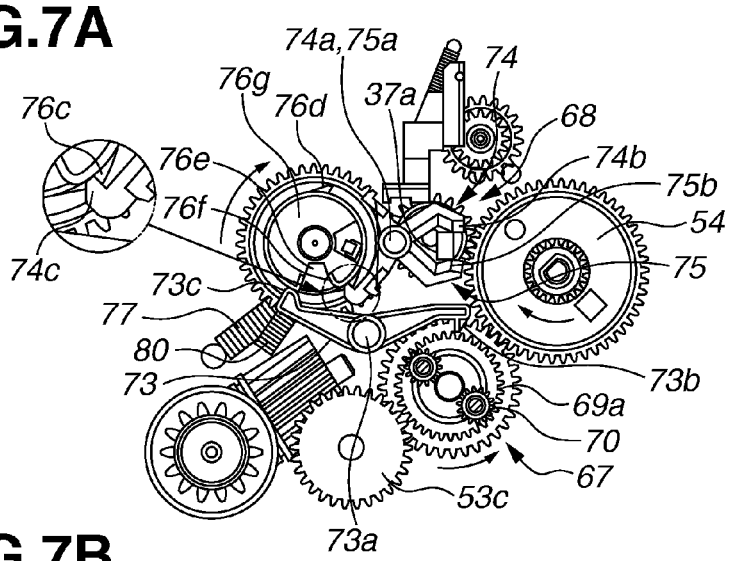
FIGS. 7A, 7B, 7C, 7D, and 7E are diagrams illustrating a configuration of a switching device according to the first exemplary embodiment.
Figure 7B:
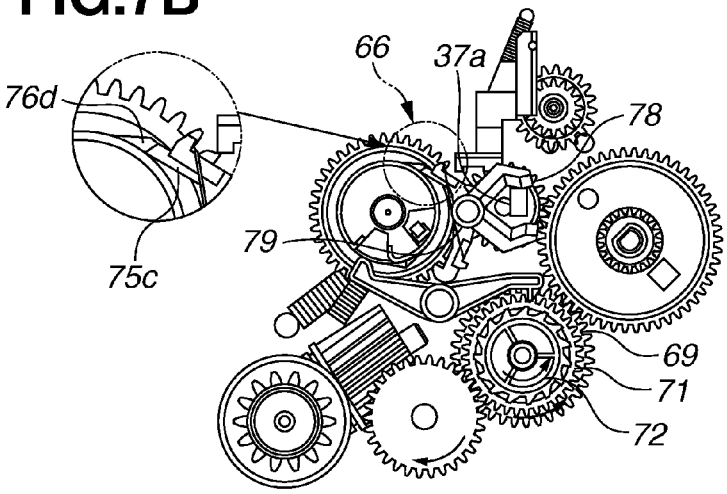
Figure 7C:
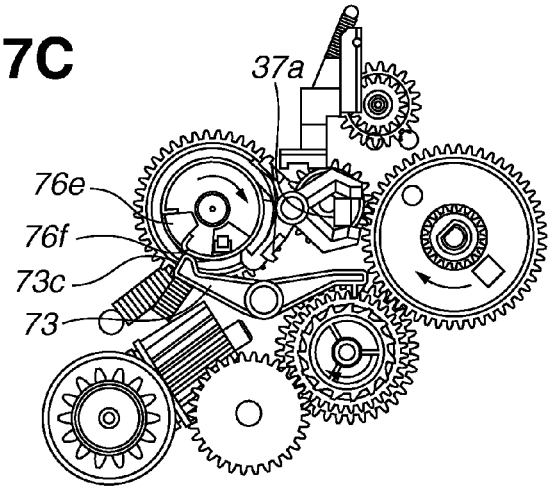
Figure 7D:
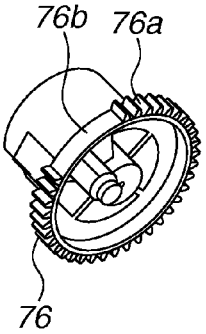

As illustrated in FIGS. 7A, 7B, 7C, 7D, and 7E, the switching device 68 includes a first latching member 74 and a second latching member 75 that interlock with the sheet surface control lever 37, and a control gear 76 (an enlarged view of FIG. 7D). The first latching member 74 and the second latching member 75 are provided to be movable between a latching position where the rotation of the control gear 76 is latched and an unlatched position where the rotation of the control gear 76 is not latched. The switching device 68 includes an extension spring 77 that elastically urges the control gear 76, a third latching member 73 that is rotatably supported and engages with the engaged gear 72 in the planetary gear mechanism 67, and a return drive gear 78 serving as a return drive unit that rotates the control gear 76. The tension spring 77 urges the control gear 76 in the clockwise direction.

Figure 9:
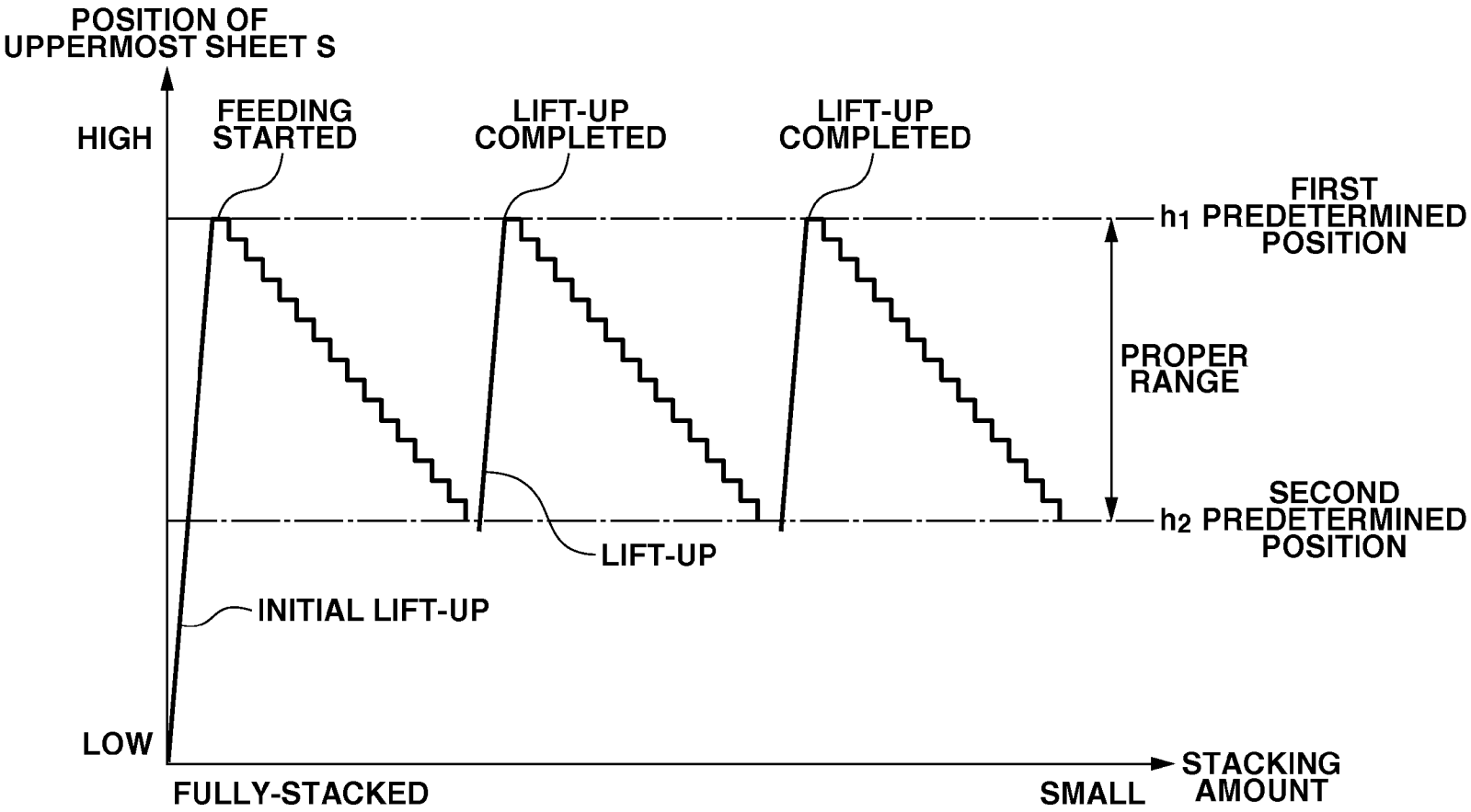
FIG. 9 is a diagram illustrating a position of an uppermost sheet and a lift-up operation according to the first exemplary embodiment.

FIG. 9 is a diagram illustrating a position of the uppermost sheet S and a lift-up operation. As illustrated in FIG. 9, the raising device starts initial lift-up in response to a detection that the feeding cassette 24 is mounted on the image forming unit A by the feeding cassette presence/absence sensor 49. When the position of the uppermost sheet S stacked on the stacking plate 21 reaches a first predetermined position, the lift-up is completed. When the sheets S stacked on the stacking plate 21 are fed, if the uppermost sheet S falls below a second predetermined position serving as a lower limit of a proper range, the switching device 68 switches the state of the planetary gear mechanism 67 to the transmitted state. The switching device 68 switches the state of the planetary gear mechanism 67 to the blocked state so that the uppermost sheet S stacked on the stacking plate 21 is stopped at the first predetermined position serving as an upper limit of the proper range. In the first exemplary embodiment, this operation is implemented by the switching device 68 serving as a mechanical mechanism without the position of the uppermost sheet S being electrically detected. The switching device 68 switches the state of the planetary gear mechanism 67 depending on a position of an interlocking device (the sheet surface control member 65 and the sheet surface control lever 37) that moves while being pressed by the uppermost sheet S stacked on the stacking plate 21. Therefore, a position of the sheet contact portion 65*a* corresponds to the position of the uppermost sheet S. Now, Details will be described.

FIG. 16 is a table illustrating the position of the uppermost sheet S stacked on the stacking plate 21 and a state of each of the members in the switching device 68. In FIG. 16, X means the position of the uppermost sheet S stacked on the stacking plate 21, $h_1$ and $h_2$ respectively mean a first predetermined position and a second predetermined position. While the position X of the uppermost sheet S is below the second predetermined position $h_2$ ($X<h_2$), the second latching member 75 latches the rotation of the control gear 76. The third latching member 73 latches the rotation of the engaged gear 72. Thus, the planetary gear mechanism 67 is in the transmitted state. While the position X of the uppermost sheet S is rising ($h_2 \leq X \leq h_1$), the second latching member 75 moves to the unlatched position where the rotation of the control gear 76 is not latched. Accordingly, when the control gear 76 rotates, and the third latching member 73 moves to the unlatched position where the rotation of the engaged gear 72 is not latched, the planetary gear mechanism 67 changes from the transmitted state to the blocked state. The control gear 76 rotates, and is latched by the first latching member 74. Thus, the stacking plate 21 is lifted up, and the uppermost sheet S is stopped at the first predetermined position $h_1$. While the position X of the uppermost sheet S is above the first predetermined position $h_1$ ($h_1<X$), the control gear 76 remains latched by the first latching member 74. The third latching member 73 does not latch the engaged gear 72, and the planetary gear mechanism 67 is in the blocked state.

Figure 7E:
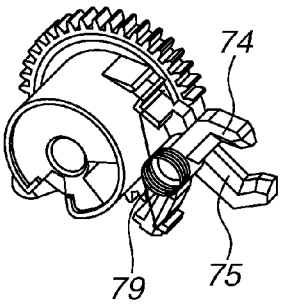

FIG. 7A illustrates a state where the position of the uppermost sheet S is the first predetermined position. FIG. 7B illustrates a state where the position of the uppermost sheet S is below the second predetermined position. FIG. 7C illustrates a state where the position of the uppermost sheet S is moving from the second predetermined position toward the first predetermined position. FIG. 7D is a perspective view of the control gear 76. FIG. 7E is a perspective view of the first latching member 74 and the second latching member 75.

Element 37*b* in FIG. 4B is a rotating shaft 37*b*. One end 37*a* of the sheet surface control lever 37 is illustrated in FIG. 7A. As illustrated in FIG. 4B, the compression spring 39 having its one end contacting the apparatus body urges the one end 37*a* of the sheet surface control lever 37 upward in FIG. 4B on the other end thereof. With this configuration, an urging force in a direction of rotation indicated by an arrow B in FIG. 4B is acting on the sheet surface control lever 37. The other end (contact portion) 37*c* of the sheet surface control lever 37 illustrated in FIG. 5A receives an urging force in a downward direction illustrated in FIGS. 5A, 5B, and 5C, to contact an upper surface of the lever contact portion 65*b* of the sheet surface control member 65. In FIG. 5A, the feeding cassette 24 remains unmounted on the image forming unit A, so that the other end 37*c* does not contact the lever contact portion 65*b*. However, while the feeding cassette 24 remains mounted on the image forming unit A, the other end 37*c* contacts the lever contact portion 65*b*. A position of the lever contact portion 65*b* changes depending on a position of the sheet contact portion 65*a* contacting the uppermost sheet S stacked on the stacking plate 21. Therefore, the position of the sheet surface control lever 37 is determined depending on the position of the uppermost sheet S stacked on the stacking plate 21. In the first exemplary embodiment, the sheet surface control member 65 serving as a first contact member and the sheet surface control lever 37 serving as a second contact member constitute an interlocking device that moves while being pressed by the uppermost sheet S stacked on the stacking plate 21.

When the height of an upper surface of the uppermost sheet S (hereinafter, referred to as a sheet surface height, as needed) rises, the pickup roller 8 and the sheet contact portion 65*a* of the sheet surface control member 65 are pressed by the uppermost sheet S, so that the sheet surface control lever 37 rotates in an opposite direction to the arrow B illustrated in FIGS. 4A, 4B, and 4C (in a counterclockwise direction in FIG. 1). More specifically, the sheet surface control lever 37 rotates, so that the other end 37*c* moves upward and the one end 37*a* moves downward.

On the other hand, when the sheets S are fed and the height of the upper surface of the uppermost sheet S decreases, the sheet surface control member 65 becomes unpressed from the uppermost sheet S, so that the sheet surface control lever 37 rotates in the direction indicated by the arrow B illustrated in FIG. 4B. More specifically, the sheet surface control lever 37 rotates, so that the other end 37*c* moves downward and the one end 37*a* moves upward.

As illustrated in FIG. 7A, the one end 37*a* of the sheet surface control lever 37 contacts the first latching member 74 and the second latching member 75, and the first latching member 74 and the second latching member 75 rotate when the one end 37*a* moves in the vertical direction. When the first latching member 74 and the second latching member 75 rotate, the control gear 76 is switched between a state where the rotation of the control gear 76 is latched and a state where the rotation of the control gear 76 is unlatched.

The control gear 76 has a gear portion 76*a* having teeth and a partially-toothless portion 76*b* having no teeth on its circumference. The control gear 76 includes an engagement protrusion 76*c* with which a latching claw 74C of the first latching member 74 engages and an engagement protrusion 76*d* with which a latching claw 75*c* of the second latching member 75 engages with each other. The rotation of the control gear 76 is regulated in a state where the latching claw 74*c* engages with the engagement protrusion 76*c*. The rotation of the control gear 76 is regulated in a state where the latching claw 75*c* engages with the engagement protrusion 76*d*. The control gear 76 includes a recess 76*e* that engages with a latching claw portion 73*c* of the third latching member 73 and a cam surface 76*f*. A latching claw portion 73*b* of the third latching member 73 latches the engaged gear 72 in a state where the latching claw portion 73*c* of the third latching member 73 fits in the recess 76*e*.

The planetary gear 70 does not rotate relative to an internal gear (input gear) 69*a* in a state where the rotation of the engaged gear 72 is regulated by the latching claw portion 73*b*. When the planetary carrier (output gear) 71 rotates as the internal gear 69*a* rotates, therefore, the stacking plate 21 is lifted up. On the other hand, the planetary gear 70 rotates relative to the internal gear 69*a* in a state where the rotation of the engaged gear 72 is not regulated. Since the planetary carrier (output gear) 71 does not rotate even if the internal gear (input gear) 69*a* rotates, therefore, the stacking plate 21 is not lifted up.

As illustrated in FIGS. 7A, 7B, 7C, 7D, and 7E, the first latching member 74 is rotatable around a rotation center 74*a* as a fulcrum. The first latching member 74 is urged in a clockwise direction in FIG. 7 by an elastic member 79, and an engagement portion 74*b* provided at one end of the first latching member 74 contacts an upper surface of the one end 37*a*. The latching claw 74*c*, which can be latched into the engagement protrusion 76*c*, described below, is provided at the other end of the first latching member 74.

When the engagement portion 74*b* in the first latching member 74 interlocks with the one end 37*a*, which swings as the height of the sheet surface control member 65 varies, the first latching member 74 moves between the latching position where the rotation of the control gear 76 is latched by the latching claw 74*c*, and the unlatched position where the rotation of the control gear 76 is not latched.

More specifically, if the sheet contact portion 65*a* (see FIGS. 4A, 4B, and 4C) is located at a position lower than the second predetermined position, the position of the one end 37*a* becomes higher (moves upward), as illustrated in FIG. 7B. When the position of the one end 37*a* becomes high, the first latching member 74 rotates so that the latching claw 74*c* moves to the unlatched position where the rotation of the control gear 76 is not latched. If the sheet contact portion 65*a* becomes higher than the second predetermined position by being pressed by the uppermost sheet S, the position of the one end 37*a* becomes low, as illustrated in FIG. 7A. When the position of the one end 37*a* becomes low, the first latching member 74 rotates with an elastic force of the elastic member 79 so that the latching claw 74*c* reaches the latching position where the rotation of the control gear 76 is latched.

On the other hand, the second latching member 75 is rotatable around a rotation center 75*a* as a fulcrum. The second latching member 75 is urged in a counterclockwise direction in FIG. 7 by the elastic member 79, and an engagement portion 75*b* provided at one end of the second latching member 75 can contact a lower surface of the one end 37*a*. The latching claw 75*c*, which can latch the rotation of the control gear 76, is provided at the other end of the second latching member 75. As illustrated in FIG. 7A, when an upper surface of the engagement portion 75*b* is pressed by a lower surface of the one end 37*c* that moves downward when the position of the uppermost sheet S rises, the second latching member 75 rotates against the elastic force of the elastic member 79 to the unlatched position where the rotation of the control gear 76 is not latched by the latching claw 75*c*. On the other hand, if the one end 37*c* is positioned above, as illustrated in FIG. 7B, the second latching member 75 is located at the latching position where the rotation of the control gear 76 is latched by the latching claw 75*c* with the elastic force of the elastic member 79.

More specifically, the latching claw 75*c* is located at the unlatched position where the rotation of the control gear 76*a* is not latched when the position of the sheet contact portion 65*a* is higher than the first predetermined position. The latching claw 75*c* is located at the latching position where the rotation of the control gear 76 is latched when the position of the sheet contact portion 65*a* is lower than the second predetermined position.

The third latching member 73 is rotatable around a rotation center 73*a* as a fulcrum, and is urged in a clockwise direction illustrated in FIGS. 7A, 7B, and 7C by a compression spring 80. The latching claw portion 73*c* is provided at one end of the third latching member 73, and the latching claw portion 73*b* is provided at the other end thereof. The latching claw portion 73*b* rotates between a latching position where the rotation of the engaged tooth portion 72*b* of the engaged gear 72 is latched and an unlatched position where the engaged tooth portion 72*b* is unlatched. The planetary gear mechanism 67 is in the transmitted state where the stacking plate 21 can be raised while the third latching member 73 latches the rotation of the engaged gear 72. On the other hand, the planetary gear mechanism 67 is in the blocked state where the rise of the stacking plate 21 is regulated while the third latching member 73 does not latch the rotation of the engaged gear 72.

While a configuration in which the switching device 68 switches the planetary gear mechanism 67 between the transmitted state and the blocked state has been described above according to the first exemplary embodiment, the present invention is not limited to this. The raising device may be switched between a permitted state where the stacking plate 21 is permitted to rise and a regulated state where the rise of the stacking plate 21 is regulated. More specifically, in the present invention, the raising device may be electrically switched between the permitted state and the regulated state.

<Lift-Up Operation>

A basic operation of the image forming apparatus according to the present exemplary embodiment will be described below with reference to FIGS. 7 and 8. FIG. 7A is a diagram obtained by removing some of the gears from FIGS. 7B and 7C for illustration. FIG. 7D is a perspective view of the control gear 76 illustrated in FIG. 7A.

When the sheets S are set on the stacking plate 21, the drive-side gear 54*a* is rotated in the clockwise direction illustrated in FIG. 7 by the feeding motor M, and thus the input gear 69 and the return drive gear 78 are driven in the counterclockwise direction. In a stage where the sheets S are set on the stacking plate 21, the contact portion 65*a* of the sheet surface control member 65 is lower than the retracting position. In such a state, the first latching member 74 is located at the unlatched position where the rotation of the control gear 76 is not latched by the latching claw 74*c*, and the second latching member 75 is located at the latching position where the rotation of the control gear 76 is latched by the latching claw 75*c*, as illustrated in FIG. 7B. Further, the third latching member 73 is located at the latching position where the rotation of the engaged gear 72 is latched by the latching claw portion 73*b*.

In a state where the rotation of the engaged gear 72 is latched by the latching claw portion 73*b* of the third latching member 73, the planetary gear mechanism 67 becomes the transmitted state, so that the rotation of the input gear 69 is transmitted to the planetary gear 70 and the planetary carrier 71. Further, the driving force is transmitted to the fan-shaped gear 25 via the gear train following the gear 53*c*, to rotate and raise the stacking plate 21.

When the stacking plate 21 turns upward, and the sheets S set on the stacking plate 21 rise, the risen sheets S contact the sheet contact portion 65*a*. From such a state, the sheet contact portion 65*a* starts to move upward and the one end 37*a* starts to move downward. As a result, the first latching member 74 turns in the clockwise direction illustrated in FIG. 7 with the elastic force of the elastic member 79.

Further, when the sheets S rise and the sheet contact portion 65*a* reaches the second predetermined position, the one end 37*a* further falls. The second latching member 75 is pressed by the falling one end 37*a*, to turn in the counterclockwise direction. The second latching member 75 turns to the unlatched position where the rotation of the control gear 76 is not latched.

When the second latching member 75 turns to the release position, the control gear 76 rotates in the clockwise direction with an urging force of the tension spring 77. As a result, the latching claw portion 73*c* of the third latching member 73 is pressed by the cam surface 76*f* of the rotating control gear 76, and the third latching member 73 rotates in the counterclockwise direction around the rotation center 73*a* as its fulcrum.

With this operation, the latching of the engaged gear 72 by the latching claw portion 73*b* of the third latching member 73 is released. Therefore, the planetary gear mechanism 67 becomes the blocked state, so that the transmission of driving toward the downstream side from the gear 53*c* is blocked, the rotation of the fan-shaped gear 25 is stopped, and the rise of the stacking plate 21 is stopped.

When the control gear 76 further turns in the clockwise direction with the urging force of the tension spring 77, the gear portion 76*a* of the control gear 76 and the return drive gear 78 mesh with each other. When the control gear 76 rotates in the clockwise direction toward the partially-toothless portion 76*b*, the control gear 76 is rotated in the clockwise direction with the urging force of the tension spring 77. As illustrated in FIG. 7A, the engagement protrusion 76*c* of the control gear 76 becomes latched by the latching claw 74*c* of the first latching member 74. The state illustrated in FIG. 7A is a state where lift-up is completed.

With the above described operation, a lift-up operation performed after the sheets S are set on the stacking plate 21 is completed, so that the sheets S becomes feedable state. Then, when the pickup roller 8 feeds the sheets S, the sheets S are conveyed toward the downstream side of the image forming unit A one by one via the separation nip portion between the feed roller 16 and the separation roller 9. As a result, the height of the uppermost sheet S is reduced by the thickness of the sheet S. When the sheet contact portion 65*a* becomes lower than the second predetermined position, the latching claw 74*c* of the first latching member 74 comes off the engagement protrusion 76*c* in the control gear 76, to enter a state illustrated in FIG. 7B where the control gear 76 urged by the tension spring 77 rotates in the clockwise direction and the latching claw 75*c* engages with the engagement protrusion 76*d*. When the fan-shaped gear 25 rotates by repeating the above described operation, the position of the uppermost sheet S on the stacking plate 21 rises, to return to the state illustrated in FIG. 7A where lift-up is completed via the state illustrated in FIG. 7C.

When this operation is repeatedly performed, the position of the uppermost sheet S is always maintained in a proper height range, as illustrated in FIG. 9. Thus, the pickup roller 8 can reliably feed the sheets S by keeping the position of the uppermost sheet S substantially constant in a predetermined position (proper range) in which the sheets S are feedable until there are no sheets S on the stacking plate 21.

<Block Diagram of Image Forming Unit A>

FIG. 10 is a block diagram illustrating the image forming unit A. A controller in the image forming unit A includes a CPU circuit unit 201 serving as a control unit, as illustrated in FIG. 10.

The CPU circuit unit 201 is connected to the feeding cassette presence/absence sensor 49 and a timer 202, and can respectively obtain detection results by the feeding cassette presence/absence sensor 49 and a measurement time by the timer 202. The CPU circuit unit 201 is connected to an electromagnetic clutch 54. The CPU circuit unit 201 is connected to the feeding motor M via a driver, to control driving of the feeding motor M.

<Contact and Separation Operations of Pickup Roller 8>

A configuration and control of a movement device, which causes the pickup roller 8 to contact with (a falling operation) and to separate from (a rising operation) the sheets S on the stacking plate 21, will be described below. FIGS. 11A, 11B, 12A, 12B, and 12C illustrate the configuration of the movement device. The movement device moves the holder 47, to move the pickup roller 8 and the sheet surface control member 65 that are retained in the holder 47.

A drive frame 56, which retains a drive train from the feeding motor M, retains gears 57*a* and 57*b*, which mesh with the gear 53*b* illustrated in FIGS. 6A and 6B, and a separation member 58. A one-way clutch (clutch member) 59 is provided between the gear 57*a* and the gear 57*b*. A rack gear is provided in the separation member 58, and engages with the gear 57*b*. A tension spring 60 is acting between the separation member 58 and the drive frame 56. The separation member 58 is stopped at a position (third position) where a boss shape 58*a* of the separation member 58 abuts on a guide hole 56*a* of the drive frame 56 with an elastic force of the tension spring (elastic member) 60. More specifically, the separation member 58 is elastically urged to the third position by the tension spring 60. An inverse U shape portion exists on the opposite side of the separation member 58, and engages with an engagement portion 40*c* in the pressing lever 40.

An operation of the one-way clutch 59 will be described. When the feeding motor M rotates backward (in an opposite direction to that during a feeding operation), the gear 57*a* rotates in a clockwise direction in FIG. 12A (in a direction of an arrow indicated by a solid line in FIG. 12A). The one-way clutch 59 receives a thrust force from a cam shape 57*ab* provided in the gear 57*a* to move in a direction of an arrow indicated by a broken line in FIG. 12. A gear portion 59*a* of the one-way clutch 59 meshes with serrated teeth of the gear 57*b* so that the rotation of the gear 57*a* is transmitted to the gear 57*b*. To prevent the one-way clutch 59 from continuing to idle without being along a cam shape 57*ab* in the gear 57*a*, a spring 61 for applying a load in a radial direction is acting on the one-way clutch 59.

Figure 12A:
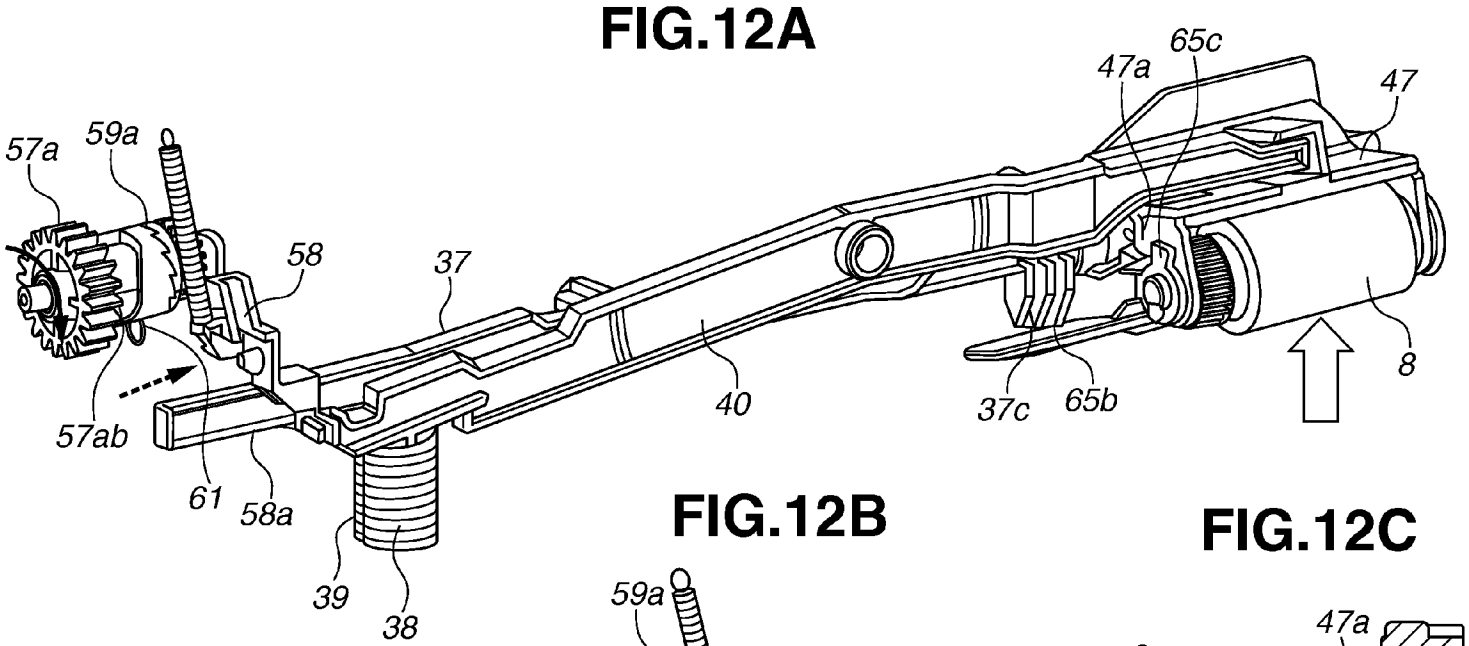
FIGS. 12A, 12B, and 12C are perspective views illustrating an operation of the movement device according to the first exemplary embodiment.
Figure 12B:
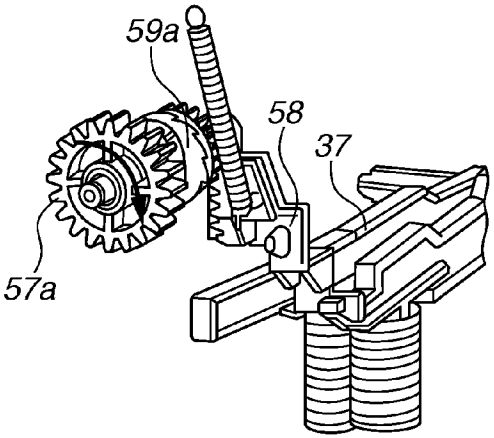

On the other hand, when the feeding motor M rotates forward (performs a feeding operation), the gear 57*a* rotates in a counterclockwise direction in FIG. 12A (in an opposite direction to the arrow indicated by the solid line in FIG. 12A). At this time, no thrust force is acting on the one-way clutch 59. Therefore, the one-way clutch 59 moves in a direction from the gear 57*b* to the gear 57*a* due to an inclined plane shape of the serrated teeth. With this operation, the rotation of the gear 57*a* becomes untrnsmitted to the gear 57*b*. More specifically, the one-way clutch 59 transmits a driving force for backward rotation of the feeding motor M to the separation member 58 and does not transmit a driving force for forward rotation of the feeding motor M to the separation member 58.

An operation of the separation member 58 will be described below.

The image forming unit A includes the timer 202 that measures an elapsed period of time from a final job. From the viewpoint of energy saving, when the timer 202 detects that a predetermined period of time has elapsed from the final job, the image forming unit A enters a sleep mode in which it stands by with minimum power consumption.

On the other hand, when a state where the pickup roller 8 contacts the sheets S continues for several hours to one or more days, a shape and a surface property of the sheets S may be locally affected depending on an environment in which the image forming unit A is placed and a material on surfaces of the sheets S. Therefore, in the first exemplary embodiment, the CPU circuit unit 201 performs a rising operation for separating the pickup roller 8 from the sheets S by rotating the feeding motor M backward using the elapsed period of time detected by the timer 202 as a trigger. More specifically, even if a predetermined period of time has elapsed since an operation of feeding the last sheet S by the pickup roller 8 has ended, the CPU circuit unit 201 separates the pickup roller from the sheets S if an operation of feeding the succeeding sheet S is not performed. After the pickup roller 8 is separated from the sheets S, the image forming unit A enters a sleep mode.

Figure 11B:
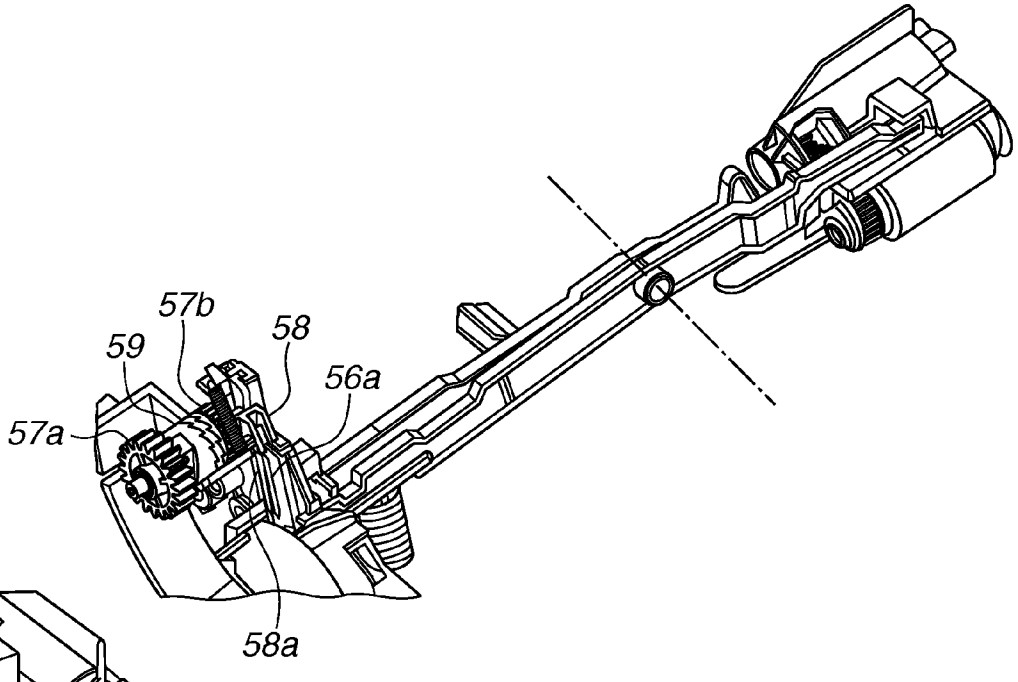
FIGS. 11A and 11B are perspective views illustrating a configuration of a movement device according to the first exemplary embodiment.
Figure 11A:
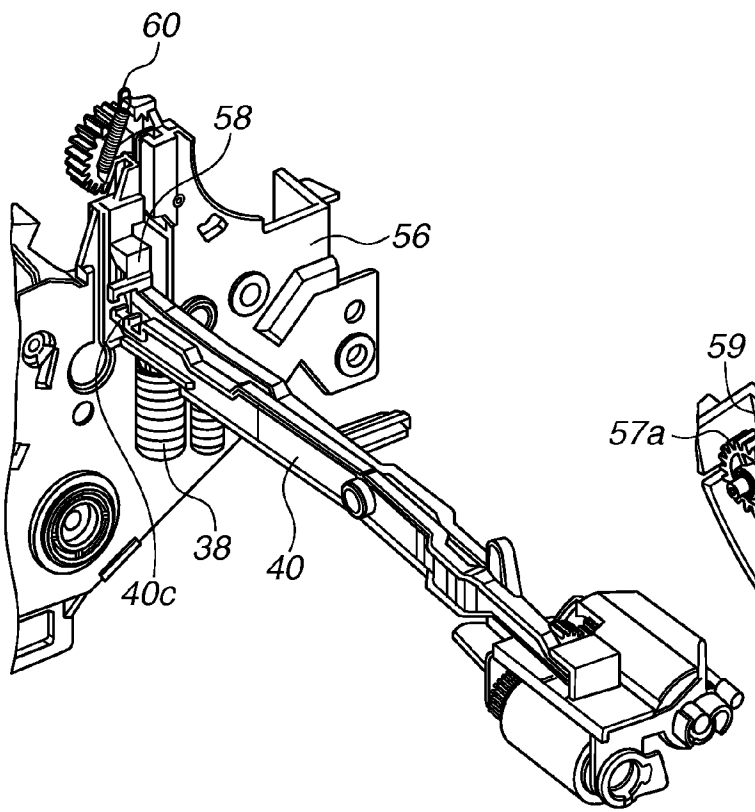

When the feeding motor M rotates backward, the separation member 58 receives the driving force from the gear 57*b*, to move downward in FIGS. 11A and 11*b*. The separation member 58, which has moved, presses the engagement portion 40*c* in the pressing lever 40 by the above described inverse U-shaped portion. The pressed lever 40 swings (rotates in a counterclockwise direction in FIG. 11B), to raise the roller holder 47. With this operation, the pickup roller 8, which is supported on the roller holder 47, and the sheet surface control member 65 also rise. Thus, the pickup roller 8 is separated from the uppermost sheet S that is stacked on the stacking plate 21 lifted up and becomes feedable. A position of the separation member 58 at this time is a fourth position. More specifically, the separation member 58 presses (contacts), when it moves (falls) from the third position to the fourth position, the pressing lever 40 against an elastic force of the compression spring 38, so that the roller holder 47 rises.

An amount of movement of the separation member 58 is set based on a period of time required for backward rotation (an amount of backward rotation) of the feeding motor M so that the pickup roller 8 is at a position sufficiently spaced apart from the uppermost sheet S. More specifically, when the CPU circuit unit 201 causes the feeding motor M to rotate backward by a first predetermined amount, the separation member 58, which is located at the third position, moves to the fourth position against the elastic force of the tension spring 60. Thus, the pickup roller 8, which is located at a contact position where it contacts the sheets S, moves to a retracting position where it retracts upward from the contact position.

Figure 12C:
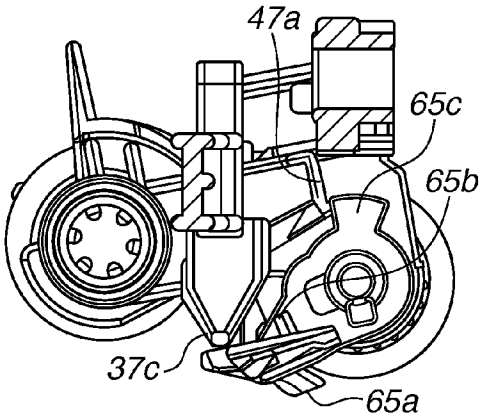

FIG. 12C is a partially enlarged view around the pickup roller 8 and the feed roller 16. When the movement device moves the roller holder 47 upward to separate the pickup roller 8, a rotation stop portion (contact portion) 65*c* of the sheet surface control member 65 contacts a rib (contacted portion) 47*a* of the roller holder 47. In this way, upward movement of the sheet surface control member 65 is regulated, so that a position of the sheet surface control member 65 corresponding to the roller holder 47 is determined. When the position of the sheet surface control member 65 is determined, the height in a vertical direction in the figure of the sheet surface control lever 37 is also determined. More specifically, in the first exemplary embodiment, the rotation stop portion 65*c* and the rib 47*a* constitute a regulation unit that regulates the movement of the interlocking device (the sheet surface control member 65 and the sheet surface control lever 37).

<Positional Relationship between Pickup Roller 8 and Sheet Surface Control Member 65>

A positional relationship between the pickup roller 8 and the sheet surface control member 65 will be described below with reference to FIGS. 13A to 13E. FIGS. 13A to 13E are partial sectional views illustrating the positional relationship between the pickup roller 8 and the sheet surface control member 65.

Figures 13A, 13B, 13C, 13D, 13E:
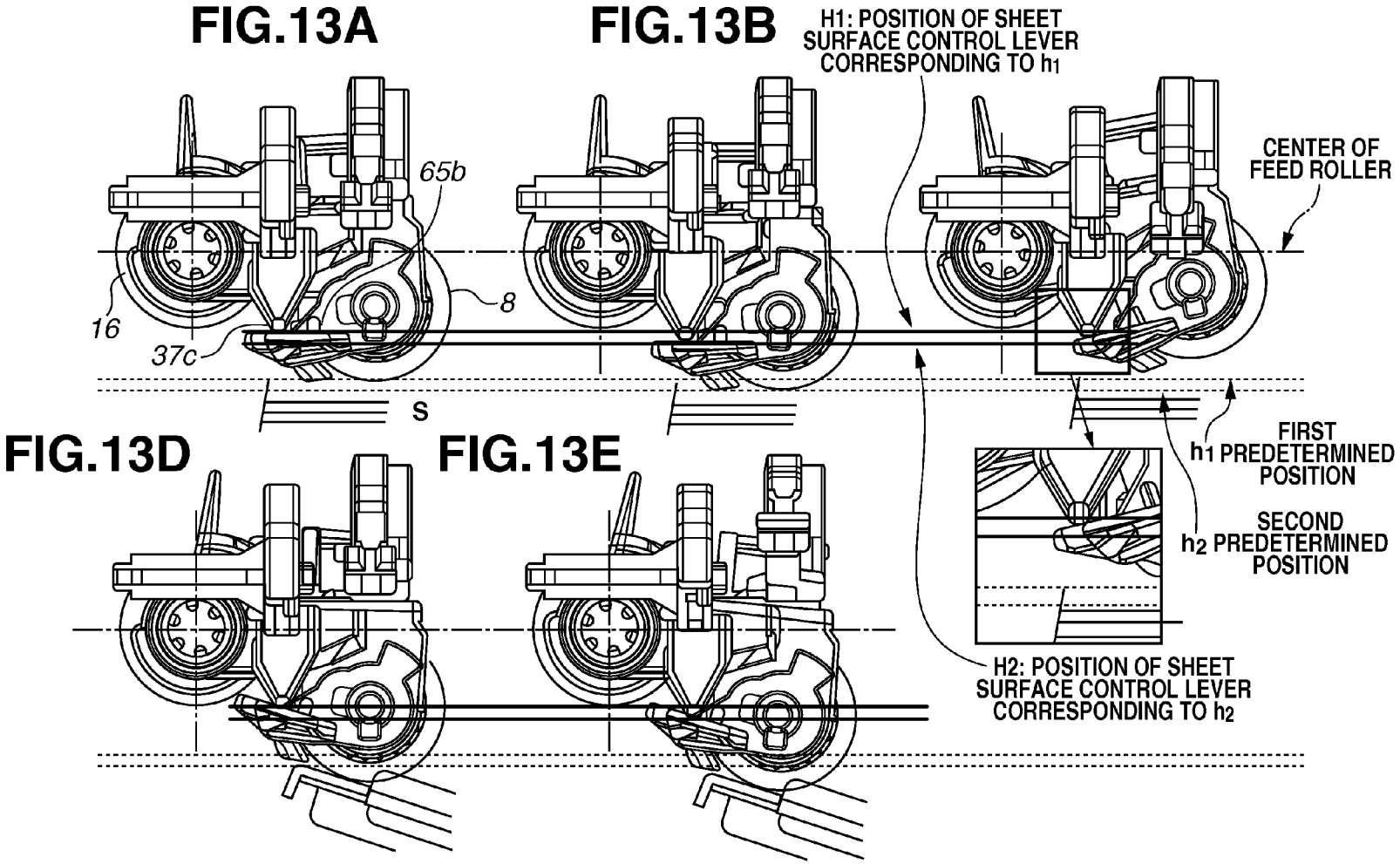
FIGS. 13A, 13B, 13C, 13D, and 13E are diagrams each illustrating a positional relationship between a pickup roller and a sheet surface control member according to the first exemplary embodiment.

FIG. 13A illustrates a state immediately after a large number of sheets S have been stacked on the stacking plate 21 and lift-up is completed. FIG. 13B illustrates a state immediately before the large number of sheets S are stacked on the stacking plate 21, and lift-up is started. FIG. 13C illustrates a state where the movement device has performed a separation operation of the pickup roller 8 from the state illustrated in FIG. 13A. FIG. 13D illustrates a state immediately after the one sheet S has been stacked on the stacking plate 21 and lift-up is completed. FIG. 13E illustrates a state immediately before the lift-up is started after the sheets S have been fed from the state illustrated in FIG. 13D and one of the sheets S remains. Broken lines in FIGS. 13A to 13E respectively indicate a first predetermined position $h_1$ and a second predetermined position $h_2$. Positions of the sheet surface control lever 37 respectively corresponding to the first predetermined position $h_1$ and the second predetermined position $h_2$ are indicated by thick solid lines (H1 and H2).

The image forming apparatus according to the first exemplary embodiment is configured in such a manner that the movement of the sheet surface control member 65 is regulated by performing the separation operation of the pickup roller 8 the movement device when the state illustrated in FIG. 13A changes to the state illustrated in FIG. 13C. More specifically, by the rotation stop portion 65*c* contacting the rib 47*a*, the movement of the sheet surface control member 65 is regulated, and the movement of the sheet surface control lever 37 interlocking with the sheet surface control member 65 is also regulated. In this way, the one end 37*c* of the sheet surface control lever 37 is maintained at a position higher than the solid line H2. Therefore, the planetary gear mechanism 67 does not change from the blocked state to the transmitted state.

Figure 14:
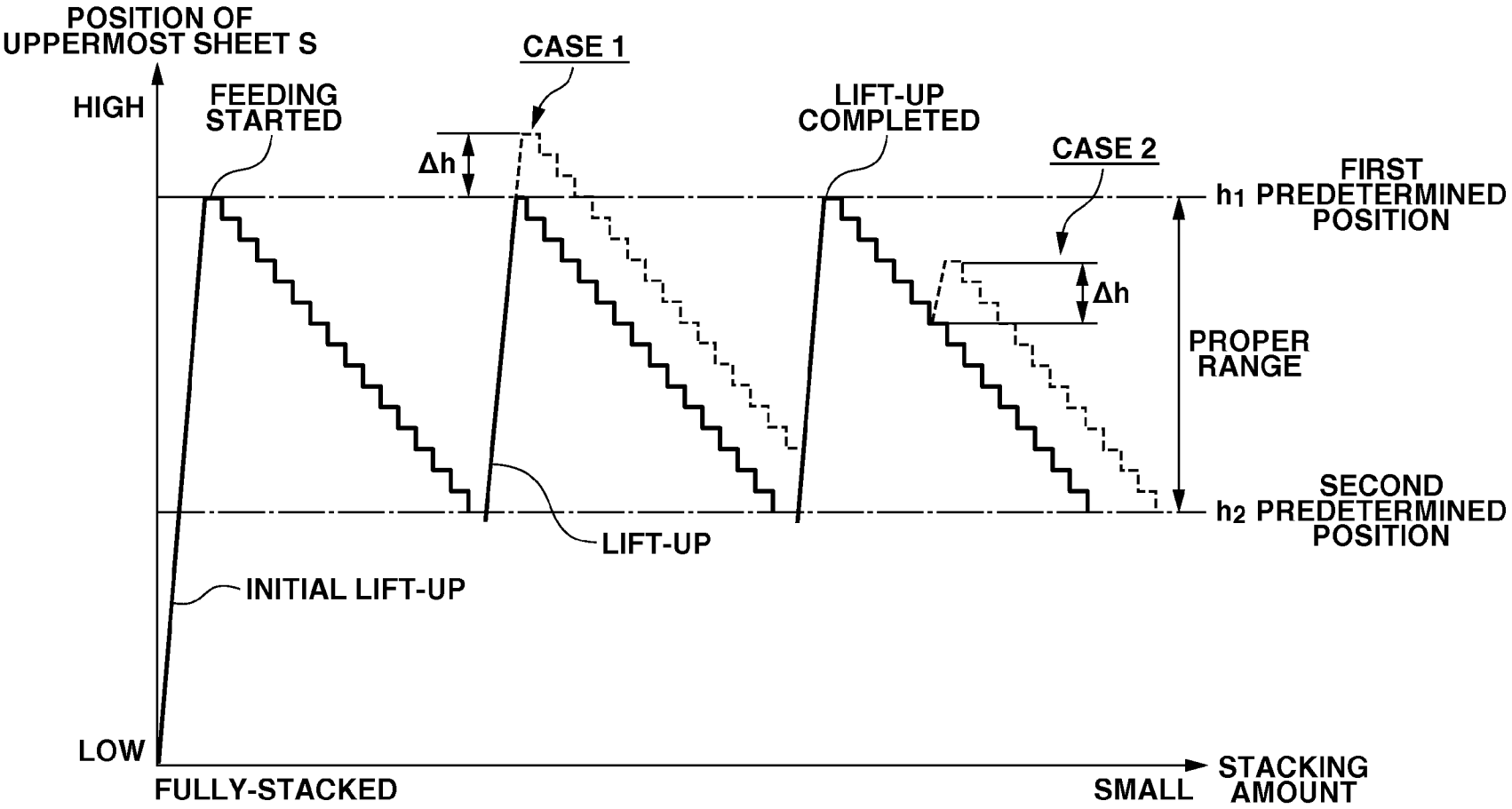
FIG. 14 is a diagram illustrating a position of an uppermost sheet and a lift-up operation in a configuration including no regulation unit.

FIG. 14 illustrates a position of the uppermost sheet S and a lift-up operation in a configuration including no regulation unit. If the one end 37*c* of the sheet surface control lever 37 moves to a position lower than the position H2 without movement of the sheet surface control member 65 and the sheet surface control lever 37 being regulated, the planetary gear mechanism 67 changes from the blocked state to the transmitted state. When the movement device performs a falling operation of lowering the pickup roller 8 from the retracting position to the contact position, the gear portion 59*a* of the one-way clutch 59 and serrated teeth of the gear 57*b* are disengaged from each other according to the forward rotation operation of the feeding motor M. The stacking plate 21 is lifted up for a period of time elapsed until the pickup roller 8 contacts the sheets S by a normal rotation operation of the feeding motor M. The uppermost sheet S rises to a position higher than the first predetermined position $h_1$ by $\Delta h$, and as a result deviates from a proper range, like in a case 1 illustrated in FIG. 14. If the position of the uppermost sheet S when the movement device starts to perform a separation operation of the pickup roller 8 is lower than the first predetermined position $h_1$ by $\Delta h$ or more, like in a case 2 illustrated in FIG. 14, the position of the uppermost sheet S does not exceed a proper height range during a contact operation for the pickup roller 8.

According to the first exemplary embodiment, the position of the uppermost sheet S can be prevented from exceeding the proper range, like in the above described case 1. Therefore, a sheet feeding performance can be kept high. The same is true when the movement device performs the separation operation for the pickup roller 8 from the states illustrated in FIGS. 13D and 13E.

More specifically, according to the first exemplary embodiment, the position of the uppermost sheet S can be kept in the proper range even in a configuration in which the rising operation of the stacking plate 21 by the raising device and the falling operation of the pickup roller 8 by the movement device are performed with the same driving force (forward rotation of the feeding motor M). The present invention is not to be limited to such a configuration.

While the configuration in which the planetary gear mechanism 67 is used for a part of the driving transmission unit that transmits the driving force of the feeding motor M to the lifting plate 22 has been described in the first exemplary embodiment, the present invention is not to be limited to this.

When a feeding operation is started (i.e., the feeding motor M rotates forward), the gear 57*b* is changed into a state of not receiving the driving force, as described above. Therefore, the separation member 58 is pushed up with respective forces of the compression sprig 38 and the tension sprig 60, so that the pressing lever 40 swings (rotates in a clockwise direction illustrated in FIG. 11B). When the pickup roller 8 contacts the sheet S, the swing of the pressing lever 40 is stopped. The separation member 58 further rises to a first position where it is disengaged from the engagement portion 40*c* of the pressing lever 40.

In the first exemplary embodiment, the tension spring 60 is provided to prevent the separation member 58 from not returning to the third position due to a friction loss after the gear 57*b* and the separation member 58 are disengaged from each other. With this configuration, even if the image forming apparatus is stopped during the contact operation and the separation operation due to a power failure, the CPU circuit unit 201 rotates the feeding motor M forward by a second predetermined amount so that the separation member 58 can be reliably returned to the third position. More specifically, the CPU circuit unit 201 can move the separation member 58 from the fourth position to the third position by rotating the feeding motor M by the second predetermined amount. In this way, the pickup roller 8, which is located at the retracting position, moves to the contact position. More specifically, in the first exemplary embodiment, the separation member 58, the tension spring 60, and the one-way clutch 59 constitute the movement device that moves the pickup roller 8 between the contact position and the retracting position. The second predetermined amount may be the same as the first predetermined amount.

<Flowchart and Timing Chart in First Exemplary Embodiment>

Figure 15A:
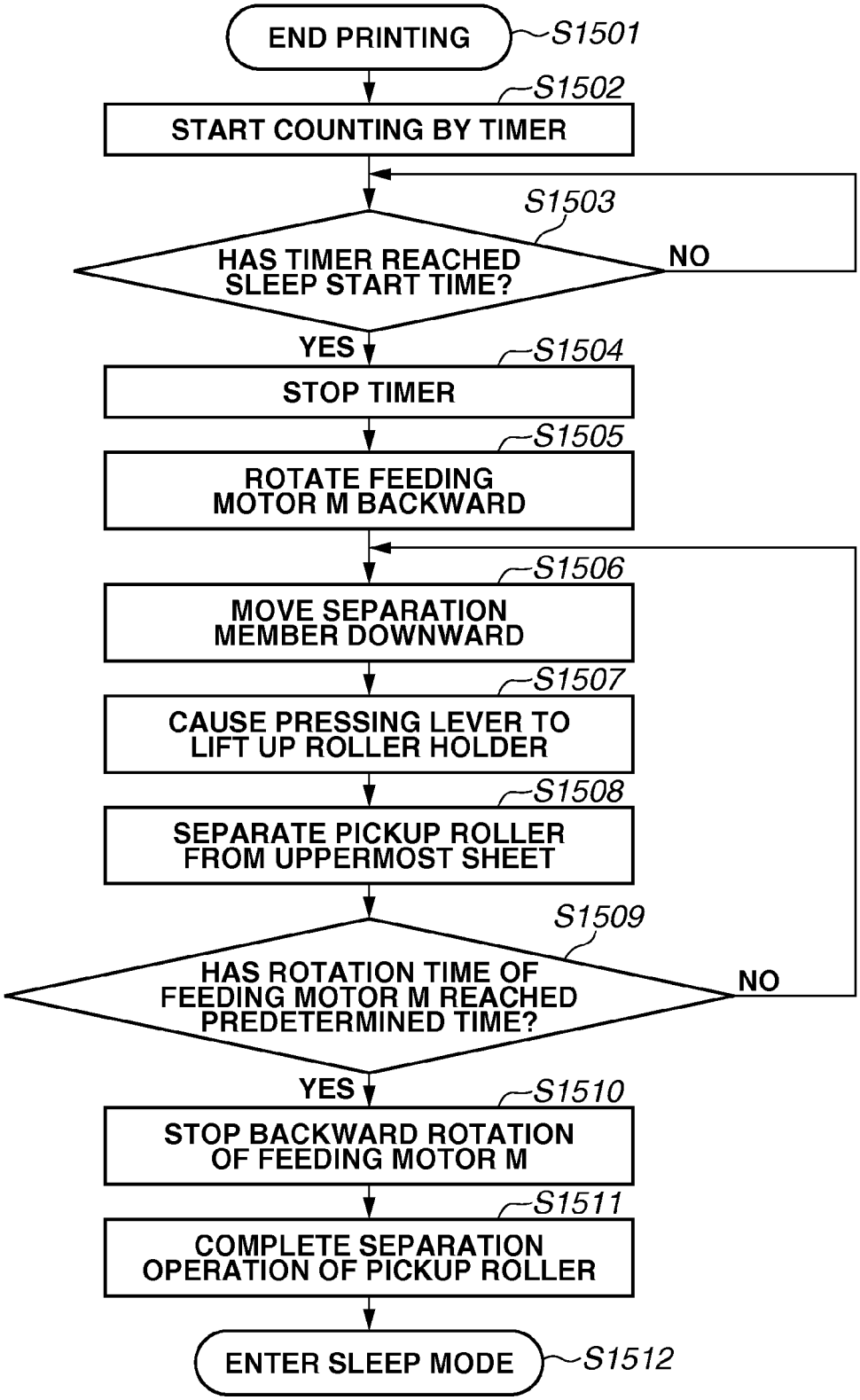
FIGS. 15A and 15B are respectively a flowchart and a timing chart relating to a contact operation and a separation operation of a pickup roller based on a timer according to the first exemplary embodiment.
Figure 15B:
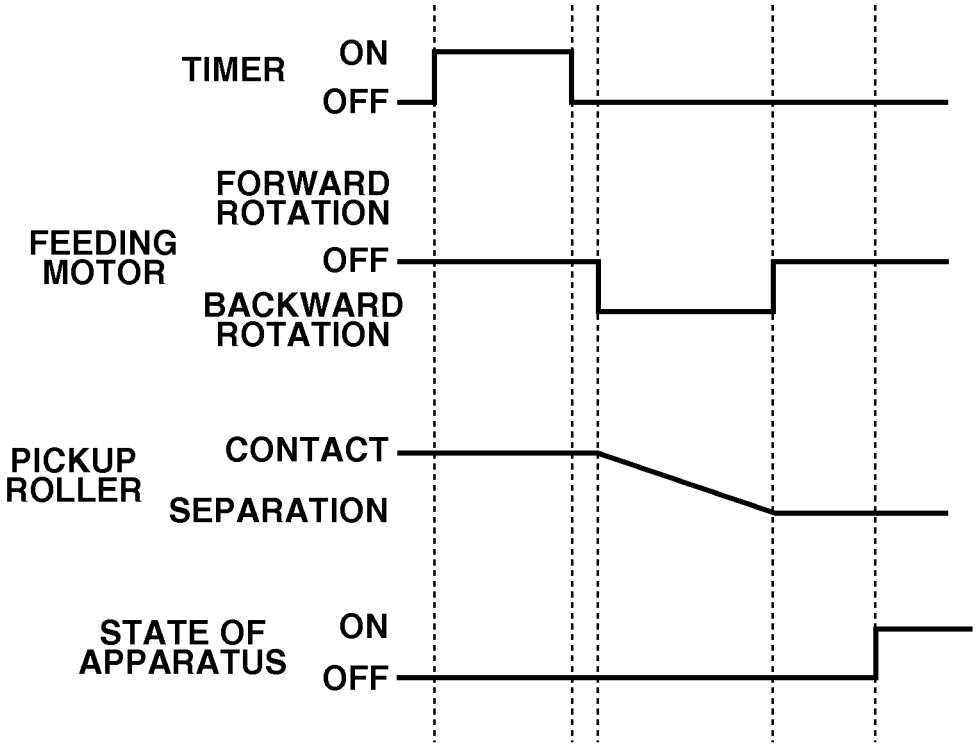

FIGS. 15A and 15B are respectively a flowchart and a timing chart according to the first exemplary embodiment. In step S1501, the CPU circuit unit 201 ends a printing operation. In step S1502, the CPU circuit unit 201 starts counting by the timer 202. In step S1503, the CPU circuit unit 201 determines whether the timer 202 has reached a sleep start time (a predetermined period of time has elapsed). If the timer 202 has reached the sleep start time (YES in step S1503), then in step S1504, the CPU circuit unit 201 stops the timer 202. In step S1505, the CPU circuit unit 201 rotates the feeding motor M backward. With this operation, in step S1506, the CPU circuit unit 201 moves the separation member 58 downward. In step S1507, the CPU circuit unit 201 causes the pressing lever 40 to lift up the roller holder 47. In step S1508, the CPU circuit unit 201 separates the pickup roller 8 from the uppermost sheet S. In step S1509, the CPU circuit unit 201 determines whether a period of time required to rotate the feeding motor M has reached a predetermined period of time. If the period of time required to rotate the feeding motor M has reached the predetermined period of time (YES in step S1509), then in step S1510, the CPU circuit unit 201 stops the backward rotation of the feeding motor M. In step S1511, the CPU circuit unit 201 completes an operation for separating the pickup roller 8 by the movement device. In step S1512, the CPU circuit unit 201 causes the image forming unit A to enter a sleep mode.

According to the above described first exemplary embodiment, a detection unit (sensor) for detecting a position of the pickup roller 8 is not required. Further, the separation member 58 does not contact the pressing lever 40 at the third position. Therefore, the separation member 58 does not affect feeding pressure.

Thus, in the first exemplary embodiment, the contact and separation operations of the pickup roller 8 are implemented with energy saving, in small size, and at low cost by using the one-way clutch 59 and using the forward and backward rotations of the feeding motor M. Further, a range of a sheet surface height is not increased more than necessary.

The force of the compression spring 38, which generates the feeding pressure, acts on the feeding motor M while the pickup roller 8 is separated from the sheets S. However, a speed reduction ratio between the feeding motor M and the separation member 58 is set so that this force does not exceed a detent torque of the feeding motor M. More specifically, a state where the separation member 58 is located at the retracting position is maintained with the detent torque of the feeding motor M. While a configuration in which the amount of movement of the separation member 58 is controlled according to a period of time required for the backward rotation of the feeding motor M has been described in the above described first exemplary embodiment, a similar effect can be clearly expected even in a configuration in which the number of steps of a stepping motor is managed.

The CPU circuit unit 201 does not transmit the driving force to the feed roller shaft 41 and the pinion 27 (raising device) by cutting off the transmission of the driving force of the electromagnetic clutch 54 in the drive train illustrated in FIG. 6 when the pickup roller 8 is separated from the sheets S. Similarly, the CPU circuit unit 201 cuts off the transmission of the driving force of the electromagnetic clutch 54 even when the feeding motor M is rotated forward to move the pickup roller 8 from the retracting position to the contact position. The present invention is not to be limited to the configuration including the electromagnetic clutch 54. A configuration in which transmission of driving force is controlled by a partially-toothless gear and a solenoid may be used.

While the control for separating the pickup roller 8 based on the counting by the timer 202 has been described in the above description, the present invention is not to be limited to this. In the first exemplary embodiment, the control for separating the pickup roller 8 based on an OFF signal of the power switch 203 (FIG. 10) provided in the apparatus body can also be performed, as described below.

Figure 17A:
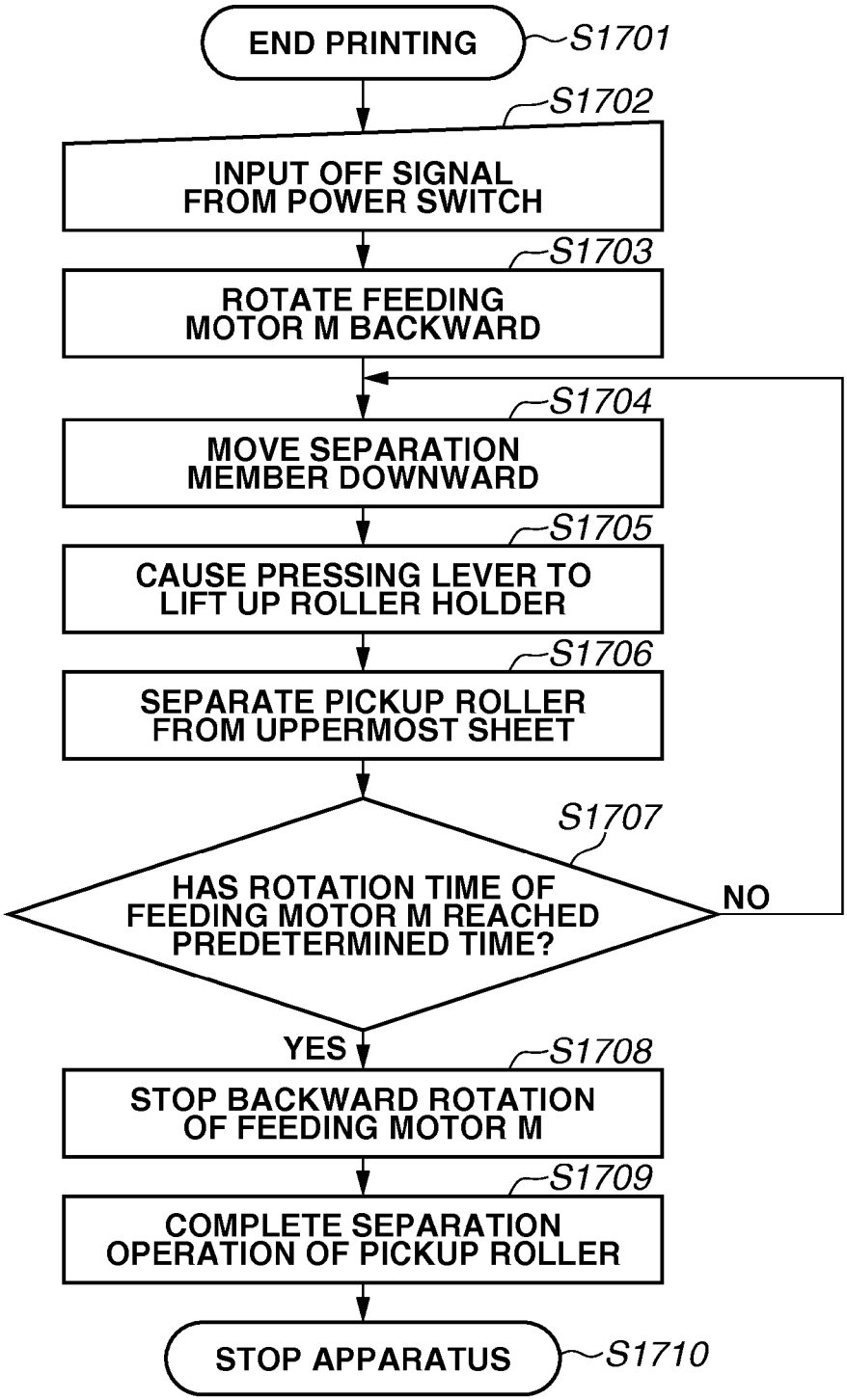
FIGS. 17A and 17B are respectively a flowchart and a timing chart relating to a contact operation and a separation operation of a pickup roller based on a power switch according to the first exemplary embodiment.
Figure 17B:
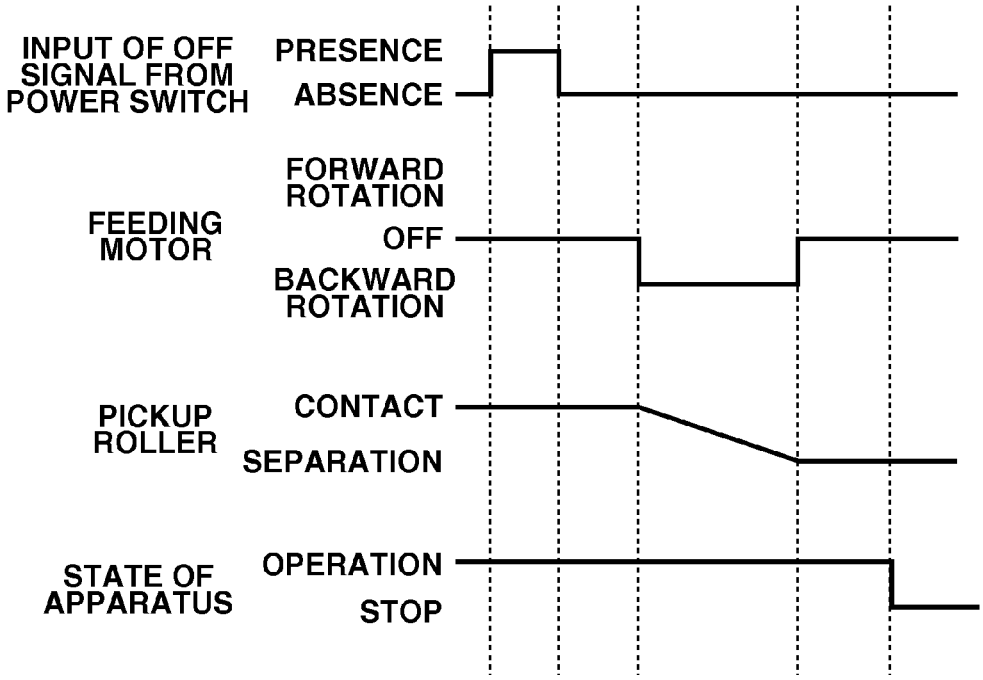

More specifically, when the power switch 203 is operated by the user, to output the OFF signal, the CPU circuit unit 201 rotates the feeding motor M backward by a first predetermined amount, to separate the pickup roller 8 from the sheets S. Then, the image forming apparatus enters a stopped state. FIGS. 17A and 17B are respectively a flowchart and a timing chart according to the above described operation. As illustrated in FIGS. 17A and 17B, in step S1702, the CPU circuit unit 201 rotates the feeding motor M backward based on the input of the OFF signal from the power switch 203. Other flows and operations are similar to those illustrated in FIG. 15A, and hence description thereof is not repeated.

As described above, the present exemplary embodiment may have a configuration in which the feeding device 13 has no timer if the pickup roller 8 is separated while interlocking with the OFF signal from the power switch 203.

Now, a second exemplary embodiment will be described below. In the second exemplary embodiment, descriptions of configurations and operations common to those in the first exemplary embodiment are omitted, as needed. A feeding device according to the second exemplary embodiment differs from that according to the first exemplary embodiment in a configuration of a sheet surface control member 65.

Figure 18A:
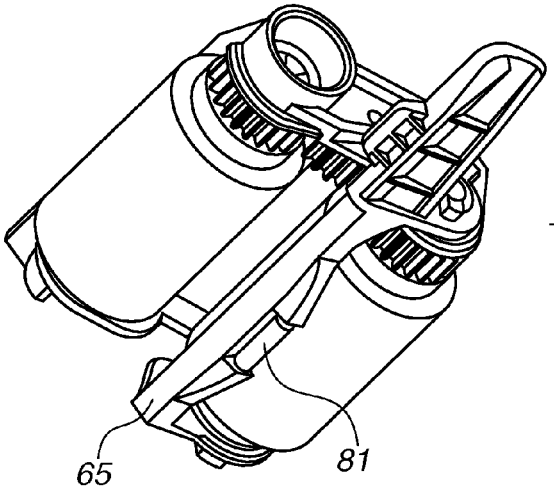
FIGS. 18A and 18B are respectively a perspective view illustrating a pickup roller unit and a diagram illustrating a relationship between contact and separation operations and the height of a sheet surface according to a second exemplary embodiment.
Figure 18B:
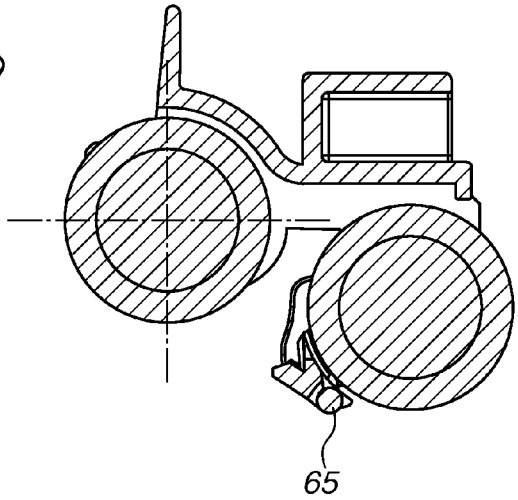
Figure 19:
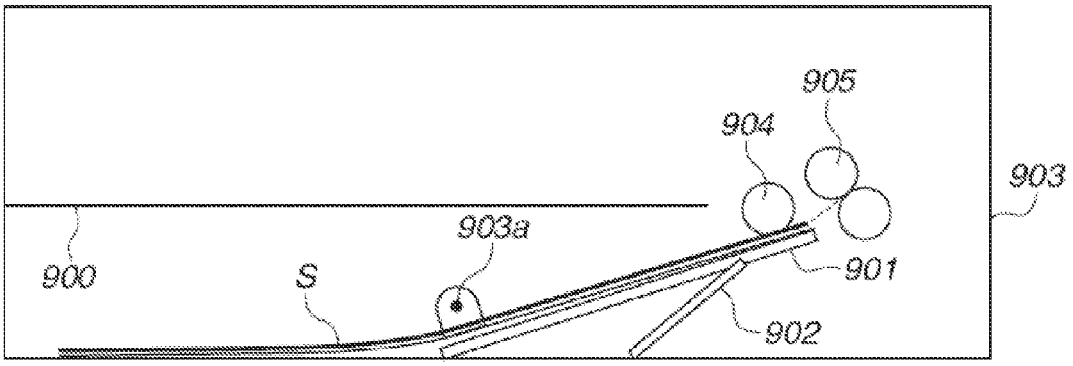
FIG.19 PRIOR ART
FIG. 19 is a diagram illustrating a configuration of a feeding cassette discussed in Japanese Patent Application Laid-Open No. 2013-180842.

FIGS. 18A and 18B are respectively a perspective view and a cross-sectional view illustrating a configuration around a feeding frame unit and a pickup roller 8 in the second exemplary embodiment. FIG. 18A is a perspective view, and FIG. 18B is a cross-sectional view at the center in a longitudinal direction of the pickup roller 8.

In the second exemplary embodiment, a roller (driven rotating member) 81 parallel to an axial direction of the pickup roller 8 is provided in a substantially central part in a longitudinal direction of a sheet surface control member 65. The roller 81 is rotatable in a feeding direction, and is retained in the sheet surface control member 65. With this configuration, the roller 81 rotates while being driven by sheets S during a feeding operation. Therefore, the sheet surface control member 65 can be prevented from being worn due to the friction with the sheets S. Therefore, according to the second exemplary embodiment, the heights (H1 and H2) of a sheet surface control lever 37 corresponding to a first predetermined position $h_1$ and a second predetermined position $h_2$ can be restrained from deviating. More specifically, according to the second exemplary embodiment, a position of the uppermost sheet S can be more satisfactorily kept in a proper range.

While a configuration in which the present invention is applied to a laser printer has been described in the above described embodiments, the present invention is not to be limited to this. The present invention may also be applied to other image forming apparatuses such as a copying machine and a multifunction peripheral. While an image forming unit using an electrophotographic image forming process has been described as an example of an image forming unit that forms an image on the sheet, the present invention is not to be limited to the image forming unit using the electrophotographic image forming process. For example, the present invention may also be applied to an image forming unit that forms an image on sheets using an inkjet image forming process for forming an image on a sheet by discharging an ink liquid from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-245211, filed Dec. 3, 2014, which is hereby incorporated by reference herein in its entirety.

What is claimed is:

1. A feeding device comprising:

a stacking member configured to stack a sheet thereon;

a raising device configured to raise the stacking member;

a feeding member configured to be movable between a contact position and a retracting position, and to rotate in contact with the sheet stacked on the stacking member in a state of being located at the contact position to feed the sheet;

an interlocking device including a sheet contact portion configured to contact the sheet stacked on the stacking member, and configured to move by being pressed by the sheet stacked on the stacking member in a case where the raising device raises the stacking member;

a switching device configured to mechanically switch the raising device between a permitted state, where the stacking member is permitted to rise, and a regulated state, where the rise of the stacking member is regulated according to a position of the interlocking device;

a holding member configured to hold the feeding member and the interlocking device;

a movement device configured to move the feeding member to the retracting position above the contact position by moving the holding member; and a regulation device configured to regulate the movement of the holding member, wherein the regulation device contacts with the holding member so that the state of the raising device does not change from the regulated state to the permitted state.

2. The feeding device according to claim 1, wherein the interlocking device includes a first contact member including the sheet contact portion and configured to move by being pressed by the sheet stacked on the stacking member, and a second contact member including a second contact member contact portion configured to contact the first contact member, and configured to move by being pressed against the first contact member.

3. The feeding device according to claim 2, wherein the switching device includes a first latching member and a second latching member configured to interlock with the second contact member to switch the state of the raising device between the permitted state and the regulated state.

4. The feeding device according to claim 1, wherein the raising device includes a raising member configured to raise the stacking member, and a driving force transmission device configured to transmit a driving force generated by the driving unit to the raising member.

5. The feeding device according to claim 4, wherein the switching device switches a state of the driving force transmission device between a transmitted state where the driving force is transmitted and a blocked state where the driving force is blocked.

6. The feeding device according to claim 4, wherein the interlocking device is movable relative to the holding member by being pressed by the sheet stacked on the stacking member in a case where the raising device raises the stacking member.

7. The feeding device according to claim 1, wherein the interlocking device is movable relative to the holding member by being pressed by the sheet stacked on the stacking member in a case where the raising device raises the stacking member.

8. The feeding device according to claim 1, further comprising a driving unit configured to generate a driving force, wherein the movement device receives and operates with the driving force from the driving unit, and the raising device receives and operates with the driving force from the driving unit.

9. The feeding device according to claim 8, wherein a rising operation for the stacking member by the raising device and a falling operation of the feeding member by the movement device are performed, and wherein the movement device operates with the driving force, and the raising device operates with the driving force.

10. The feeding device according to claim 9, wherein the driving unit can generate a driving force for forward rotation and a driving force for backward rotation, wherein the movement device lowers the feeding member from the retracting position to the contact position with the driving force for forward rotation, and the raising device raises the stacking member with the driving force for forward rotation, and wherein the movement device raises the feeding member from the contact position to the retracting position with the driving force for backward rotation.

11. The feeding device according to claim 10, further comprising a control unit configured to control the driving unit, wherein the control unit controls the driving unit to move the feeding member to the retracting position after a predetermined period of time has elapsed after the end of an operation for feeding the sheet by the feeding member.

12. The feeding device according to claim 11, wherein the control unit controls the driving unit to move the feeding member to the retracting position based on an OFF signal of a power switch provided in an apparatus body.

13. The feeding device according to claim 1, wherein the sheet contact portion is a rotatable rotating member.

14. An image forming apparatus comprising:

the feeding device according to claim 1; and an image forming unit configured to form an image on the sheet fed by the feeding member.

15. The feeding device according to claim 1, wherein the raising device includes a pinion configured to rotate through a drive train with a driving force generated by a driving unit, and wherein the movement device includes a drive frame that retains the drive train from the driving unit, and that retains a first gear configured to mesh with a second gear, wherein the second gear is configured to rotate with the driving force generated by the driving unit.

16. The feeding device according to claim 1, wherein the contact position is where the feeding member contacts the sheet and the retracting position is where the feeding member does not contact the sheet, and wherein the rise of the stacking member is regulated according to the position of the interlocking device and without electrically detecting a position of the sheet.

17. A feeding device comprising:

a stacking member configured to stack a sheet thereon;

a raising device configured to raise the stacking member;

a feeding member configured to rotate in contact with the sheet stacked on the stacking member in a state of being located at a contact position to feed the sheet;

an interlocking device including a sheet contact portion configured to contact the sheet stacked on the stacking member, and configured to move by being pressed by the sheet stacked on the stacking member in a case where the raising device raises the stacking member;

a switching device configured to mechanically switch a state of the raising device between a permitted state where the stacking member is permitted to rise and a regulated state where the rise of the stacking member is regulated according to a position of the interlocking device;

a holding member configured to hold the feeding member and the interlocking device;

a movement device configured to move the feeding member to a retracting position above the contact position by moving the holding member; and a regulation device configured to regulate the movement of the interlocking device in a case where the movement device moves the feeding member to the retracting position by moving the holding member.

* * * * *